US011166570B1

(12) United States Patent
Flannery et al.

(10) Patent No.: US 11,166,570 B1
(45) Date of Patent: Nov. 9, 2021

(54) HIGH CHAIR APPARATUS WITH WIDE FOOT PRINT

(71) Applicant: Regalo International, LLC, Burnsville, MN (US)

(72) Inventors: Mark A. Flannery, Longboat Key, FL (US); William D. Butterfield, River Falls, WI (US)

(73) Assignee: Regalo International, LLC, Burnsville, MN (US)

( * ) Notice: Subject to any disclaimer, the term of this patent is extended or adjusted under 35 U.S.C. 154(b) by 0 days.

(21) Appl. No.: 16/819,031

(22) Filed: Mar. 13, 2020

Related U.S. Application Data

(60) Provisional application No. 62/820,810, filed on Mar. 19, 2019.

(51) Int. Cl.
*A47D 1/02* (2006.01)
*A47D 1/00* (2006.01)

(52) U.S. Cl.
CPC ..... *A47D 1/023* (2017.05); *A47D 1/0081* (2017.05); *A47D 1/0085* (2017.05)

(58) Field of Classification Search
CPC ..... A47D 1/023
USPC ..... 297/16.2
See application file for complete search history.

(56) References Cited

U.S. PATENT DOCUMENTS

| | | | | |
|---|---|---|---|---|
| 3,416,163 | A * | 12/1968 | Jordan | A47D 1/0081 4/483 |
| 5,527,090 | A | 6/1996 | Cone, II | |
| 6,082,813 | A * | 7/2000 | Chen | A47C 4/286 297/16.1 |
| D443,777 | S | 6/2001 | Flannery et al. | |
| 6,247,750 | B1 * | 6/2001 | Tsai | A47C 4/286 297/16.2 |
| 6,419,312 | B1 | 7/2002 | Flannery et al. | |
| 7,134,714 | B1 | 11/2006 | Connery | |
| 7,281,759 | B1 | 10/2007 | Strong et al. | |
| 7,422,276 | B2 | 9/2008 | Flannery | |
| 7,591,506 | B2 | 9/2009 | Flannery | |
| 7,621,592 | B1 | 11/2009 | Flannery | |
| 7,845,719 | B2 | 12/2010 | Flannery | |
| 8,091,965 | B2 | 1/2012 | Flannery et al. | |
| 8,267,473 | B2 | 9/2012 | Flannery et al. | |
| 10,786,083 | B1 * | 9/2020 | Chen | A47C 4/286 |
| 2005/0126445 | A1 | 6/2005 | Guard et al. | |
| 2009/0206638 | A1 | 8/2009 | Hartenstine et al. | |
| 2010/0072790 | A1 * | 3/2010 | Pleiman | A47C 4/286 297/45 |
| 2017/0258244 | A1 * | 9/2017 | Waldman | A47D 1/02 |

* cited by examiner

*Primary Examiner* — Sarah B McPartlin

(57) ABSTRACT

The present highchair apparatus includes first, second, third, and fourth legs that begin to bend outwardly from a sitting receptacle from a location at the bottom of the sitting receptacle to provide a wide foot print for the high chair apparatus. The first, second, third, and fourth legs extend incrementally further away from each other from the location at the bottom of the sitting receptacle to distal ends of the legs where feet are engaged.

18 Claims, 16 Drawing Sheets

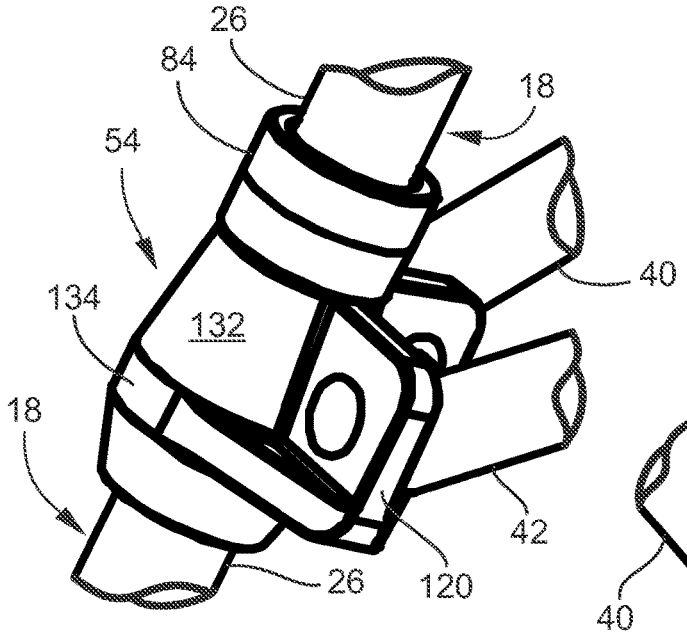
FIG. 16A
FIG. 16B
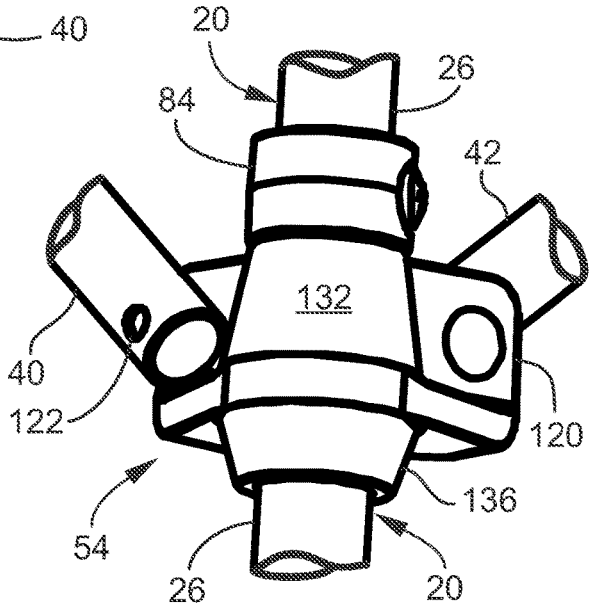
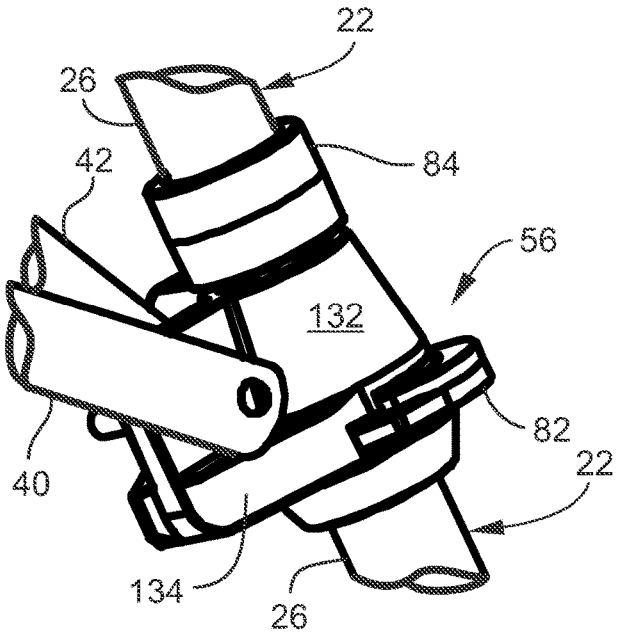
FIG. 16C
FIG. 16D
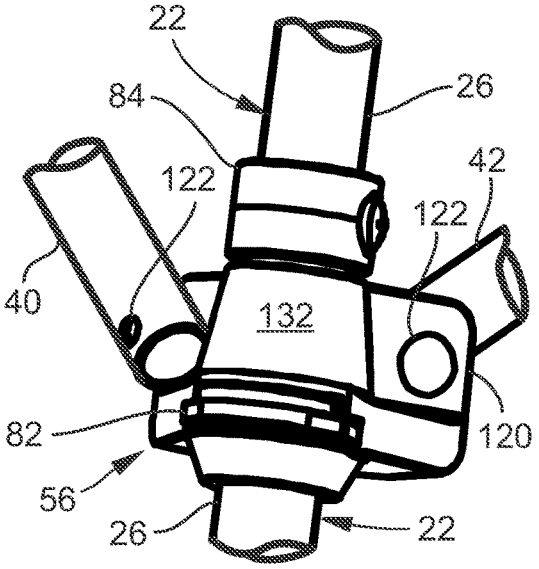

HIGH CHAIR APPARATUS WITH WIDE FOOT PRINT

This application claims the benefit under 35 U.S.C. 119(e) of U.S. Provisional Patent Application No. 62/820,810 filed Mar. 19, 2019 and entitled High Chair Apparatus With Wide Foot Print, which application is hereby incorporated by reference in its entirety into this application.

FIELD OF THE INVENTION

The present invention relates to a high chair apparatus where first, second, third, and fourth legs extend outwardly and away from each other from a sitting receptacle to distal ends of the first, second, third, and fourth legs to provide a wide and stable base.

BACKGROUND OF THE INVENTION

A high chair is a rather tall apparatus for an important member of the family: the baby of the family. The high chair is tall because its purpose is to place a child on an even keel with other members of the family at the dinner table. Unfortunately, a rather tall apparatus may have a number of issues because it is tall. For example, a tall apparatus may have a high center of gravity and be prone to tipping. A tall apparatus may be difficult to store because it takes up an inordinate amount of space. A tall apparatus may be unsteady or wobble since its parts may extend relatively far until such part is engaged by another part.

SUMMARY OF THE INVENTION

A feature of the present invention is the provision in a high chair apparatus, of a sitting receptacle in which a child sits.

Another feature of the present invention is the provision in a high chair apparatus, of first, second, third, and fourth legs engaged to the sitting receptacle and supporting the sitting receptacle relative to a floor.

Another feature of the present invention is the provision in a high chair apparatus, of each of the first, second, third, and fourth legs having an upper leg portion engaging the sitting receptacle and a lower leg portion having a lower end, where each of the lower ends is adjacent to the floor.

Another feature of the present invention is the provision in a high chair apparatus, of the first leg being a right front leg and having a right front upper leg portion and a right front lower leg portion, of the second leg being a left front leg and having a left front upper leg portion and a left front lower leg portion, of the third leg being a left rear leg and having a left rear upper leg portion and a left rear lower leg portion, and of the fourth leg being a right rear leg and having a right rear upper leg portion and a right rear lower leg portion.

Another feature of the present invention is the provision in a high chair apparatus, of first, second, third, and fourth cross-supports, where each of the cross-supports includes first and second support members pivotally engaged to each other, where each of the first and second support members extends between two adjacent upper leg portions, where each of the first and second support members includes an upper end pivotally engaged to one of the two adjacent upper leg portions at a location, where each of the first and second support members includes a lower end pivotally engaged to one of the two adjacent upper leg portions.

Another feature of the present invention is the provision in a high chair apparatus, of the first cross-support engaging the first and second legs, of the second cross-support engaging the second and third legs, of the third cross-support engaging the third and fourth legs, and of the fourth cross-support engaging the fourth and first legs.

Another feature of the present invention is the provision in a high chair apparatus, of the first, second, third, and fourth legs having a folded in position where the first, second, third, and fourth legs are adjacent to each other.

Another feature of the present invention is the provision in a high chair apparatus, of the first, second, third, and fourth legs having a folded out position where the first, second, third, and fourth legs are spaced apart from each other.

Another feature of the present invention is the provision in a high chair apparatus, of the first, second, third, and fourth legs being drawable outwardly from the folded in position to the folded out position.

Another feature of the present invention is the provision in a high chair apparatus, of the first, second, third, and fourth legs being drawable inwardly from folded out position to the folded in position.

Another feature of the present invention is the provision in a high chair apparatus, of each of the first, second, third, and fourth legs in the folded out position being further apart incrementally from each of the other first, second, third, and fourth legs from the location immediately below the sitting receptacle to the lower end of each of the first, second, third, and fourth legs such that each of the first, second, third, and fourth legs begins to extend outwardly at the location immediately below the sitting receptacle and continuously maintains an outward extension to the lower end of each of the first, second, third, and fourth legs such that the first, second, third, and fourth legs provide a wide base for the sitting receptacle.

Another feature of the present invention is the provision in a high chair apparatus, of each of the first, second, third, and fourth legs being tubular.

Another feature of the present invention is the provision in a high chair apparatus, of each of the upper leg portions being removably engageable to the respective lower leg portion.

Another feature of the present invention is the provision in a high chair apparatus, of the upper leg portion including a first elongate portion that includes a first straight axis and a second elongate portion that includes a second straight axis, and of the first and second straight axis being oblique to each other.

Another feature of the present invention is the provision in a high chair apparatus, of distal ends of the first, second, third, and fourth legs defining a plane, where the lower leg portion is oblique to the plane, where a lower elongate portion of the upper leg portion includes a straight axis that is oblique to the plane, and where an upper elongate portion of the upper leg portion includes a straight axis that is at a right angle to the plane or is at generally a right angle to said plane.

Another feature of the present invention is the provision in a high chair apparatus, of each of the first, second, third, and fourth legs tapering downwardly and outwardly from the location immediately below the sitting receptacle where the upper end of each of the first and second support members is pivotally engaged to one of the two adjacent upper leg portions, and where each of the first, second, third, and fourth legs extends upright or generally upright from the location immediately below the sitting receptacle.

Another feature of the present invention is the provision in a high chair apparatus, of the right front leg including a right front uppermost end, of the left front leg including a left front uppermost end, of the right rear leg including a right rear uppermost end, and of the left rear leg including a left rear uppermost end, where the right rear and left rear uppermost ends are disposed at a greater distance from the location immediately below the sitting receptacle than are the right front and left front uppermost ends, where the right front and left front uppermost ends engage a tray, and where the right rear and left rear uppermost ends are adjacent to a back of the sitting receptacle.

Another feature of the present invention is the provision in a high chair apparatus, of each of the first, second, third, and fourth legs including an upper collar and a lower collar, where the upper collar engages two upper ends of two adjacent cross supports, where the lower collar engages two lower ends of two adjacent cross supports, where the upper collar includes an upper axis, where the lower collar includes a lower axis, and where the upper and lower axis are oblique relative to each other.

Another feature of the present invention is the provision in a high chair apparatus, of each of the first, second, third, and fourth legs including an upper collar and a lower collar, where the upper collar engages two upper ends of two adjacent cross supports, where the lower collar engages two lower ends of two adjacent cross supports, where the upper collar is fixed on its respective leg at the location immediately below the sitting receptacle, where the lower collar is slideable on its respective leg such that the cross-supports scissor as the lower collar slides down its respective leg as the first, second, third, and fourth legs are drawn inwardly from the folded out position to the folded in position.

Another feature of the present invention is the provision in a high chair apparatus, of each of the first, second, third, and fourth legs including an upper collar and a lower collar, where the upper collar engages two upper ends of two adjacent cross supports, where the lower collar engages two lower ends of two adjacent cross supports, where the upper collar is fixed to its respective leg at the location immediately below the sitting receptacle, where the lower collar is slideable on its respective leg such that the cross-supports scissor as the lower collar slides down its respective leg as the first, second, third, and fourth legs are drawn inwardly from the folded out position to the folded in position, where the lower collar of each of the third and fourth legs is lockable to its respective third or fourth leg when the first, second, third, and fourth legs are in the folded out position.

Another feature of the present invention is the provision in a high chair apparatus, of each of the first, second, third, and fourth legs including an upper collar and a lower collar, where the upper collar engages two upper ends of two adjacent cross supports, where the lower collar engages two lower ends of two adjacent cross supports, where the upper collar is fixed to its respective leg at the location immediately below the sitting receptacle, where the lower collar is slideable on its respective leg such that the cross-supports scissor as the lower collar slides down its respective leg as the first, second, third, and fourth legs are drawn inwardly from the folded out position to the folded in position, where the lower collar of each of the first and second legs is free to slide when the first, second, third, and fourth legs are in the folded out position, when the first, second, third, and fourth legs are in the folded in position, and when the first, second, third, and fourth legs are in any position between the folded out and folded in positions.

Another feature of the present invention is the provision in a high chair apparatus, of each of the first, second, third, and fourth legs including a lower collar, where the lower collar engages two lower ends of two adjacent cross supports, where the lower collar is slideable on its respective leg such that the cross-supports scissor as the lower collar slides down its respective leg as the first, second, third, and fourth legs are drawn inwardly from the folded out position to the folded in position, and where each of the first, second, third, and fourth legs includes a stop engaged thereto and disposed immediately adjacent to the lower collar when the first, second, third, and fourth legs are in the folded out position, and where the stop is disposed between the lower collar and the sitting receptacle.

Another feature of the present invention is the provision in a high chair apparatus, of first, second, third, and fourth feet engaged respectively to the first, second, third, and fourth legs at the lower end of each of the legs, where the foot includes a receptacle for the lower end of the leg, where the receptacle includes an axis and is coaxial with the lower end and the lower leg portion, where the foot includes a bottom, and where the bottom defines a plane that engages the floor and that is oblique relative to the axis of the receptacle.

Another feature of the present invention is the provision in a high chair apparatus, of locations immediately below the sitting receptacle on the first, second, third, and fourth legs defining a plane when the first, second, third, and fourth legs are in the folded out position, where the lower leg portion is straight, where each of the lower leg portions is disposed at an oblique angle relative to the plane, where the oblique angles are identical, and further including first, second, third, and fourth feet engaged respectively to said first, second, third, and fourth legs at the lower end, where the foot includes a receptacle for the lower end, where the receptacle includes an axis and is coaxial with the lower end and lower leg portion, where the foot includes a bottom, where the bottom defines a plane that engages the floor and that is disposed at an oblique angle relative to the axis of the receptacle, and where each of the feet is interchangeable with any one of the other feet.

Another feature of the present invention is the provision in a high chair apparatus, of the sitting receptacle being flexible.

Another feature of the present invention is the provision in a high chair apparatus, of the sitting receptacle including a seat, a back, a left side, and a right side, and where each of the seat, back, left side, and right side is formed of a flexible material.

Another feature of the present invention is the provision in a high chair apparatus, of the sitting receptacle including a seat, a back, a left side, and a right side, where the seat is engaged to each of the back, left side, and right side, where the back is engaged to each of the seat, left side, and right side, where the right side is engaged to each of the seat and the back, and where the left side is engaged to each of the seat and the back, and where each of the seat, back, left side, and right side is formed of a flexible material.

Another feature of the present invention is the provision in a high chair apparatus, of a frame, where the frame includes the first, second, third, and fourth legs, where the frame further includes a tray engaged to the first and second legs, where the tray includes a rigid material that spaces apart the first and second legs when the first, second, third, and fourth legs are in the folded out position, where the tray is removable from the first and second legs, where the tray when engaged to the first and second legs prevents the first, second, third, and fourth legs from being folded from the folded out position to the folded in position, where the first, second, third, and fourth legs are foldable from the folded out position to the folded in position when the tray is disengaged from the first and second legs.

Another feature of the present invention is the provision in a high chair apparatus, of a tray, where each of the first and second legs includes an upper end that comprises a block, and where the tray engages the blocks of the upper ends of the first and second legs.

An advantage of the present invention is that the present high chair apparatus has a low center of gravity. One feature contributing to this advantage is the wide base provided by the distal ends of the first, second, third, and fourth legs.

Another advantage of the present invention is that, even though the high chair apparatus is relatively tall, storage space for the high chair apparatus is minimized by a portion of the first, second, third, and fourth legs being removable and further by cross-supports providing for a folded in position where leg portions of the first, second, third, and fourth legs extend or run adjacent to each other while only slightly extend or run away from each other.

Another advantage of the present invention is the high chair apparatus, even though tall, minimizes wobble. One feature contributing to this advantage is the set of four cross-supports having upper ends that are engaged immediately below the sitting receptacle and lower ends that are disposed somewhat adjacent to the sitting receptacle. The lower ends of the cross-supports are disposed closer to the sitting receptacle than to the distal ends of the first, second, third, and fourth legs. Another feature contributing to this advantage is that the rigid tray engages upper ends of the first and second legs so as to be a part of the frame of the high chair apparatus, where other parts to the frame include the first, second, third, and fourth legs, the four sets of cross-supports, and feet.

Another advantage of the present invention is that the lower leg portions of the first, second, third, and fourth legs are engagable to any of the upper portions of the first, second, third, and fourth legs so as to provide convenience to the end user and to maximize safety, such that lower leg portions cannot be matched with incorrect upper leg portions and such that upper leg portions cannot be matched with incorrect lower leg portions. It is correct to engage any of the lower leg portions with any of the upper leg portions.

Another advantage of the present invention is that the feet may be engaged to any of the first, second, third, and fourth legs so as to provide convenience to the end user and to maximize safety, such that feet cannot be matched with incorrect lower leg portions and such that lower leg portions cannot be matched with incorrect feet. It is correct to engage any of the feet with any of the lower leg portions.

Another advantage of the present invention is that the present high chair apparatus is inexpensive and simple to manufacture.

Another advantage of the present invention is that the present high chair apparatus is simple and easy to fold in from the folded out position and to fold out from the folded in position.

BRIEF DESCRIPTION OF THE DRAWINGS

FIG. 5 shows the wide base provided by the feet on the distal ends of the first, second, third, and fourth legs.

FIG. 3 is the folded out position of the high chair apparatus.

FIG. 16A is a perspective view of the lower collar apparatus on the right front leg of the high chair apparatus of FIG. 1.

FIG. 16B is a perspective view of the lower collar apparatus on the left front leg of the high chair apparatus of FIG. 1.

FIG. 16C is a perspective view of the lower collar apparatus on the left rear leg of the high chair apparatus of FIG. 1.

FIG. 16D is a perspective view of the lower collar apparatus on the left rear leg of the high chair apparatus of FIG. 3.

DESCRIPTION

Figure 1:
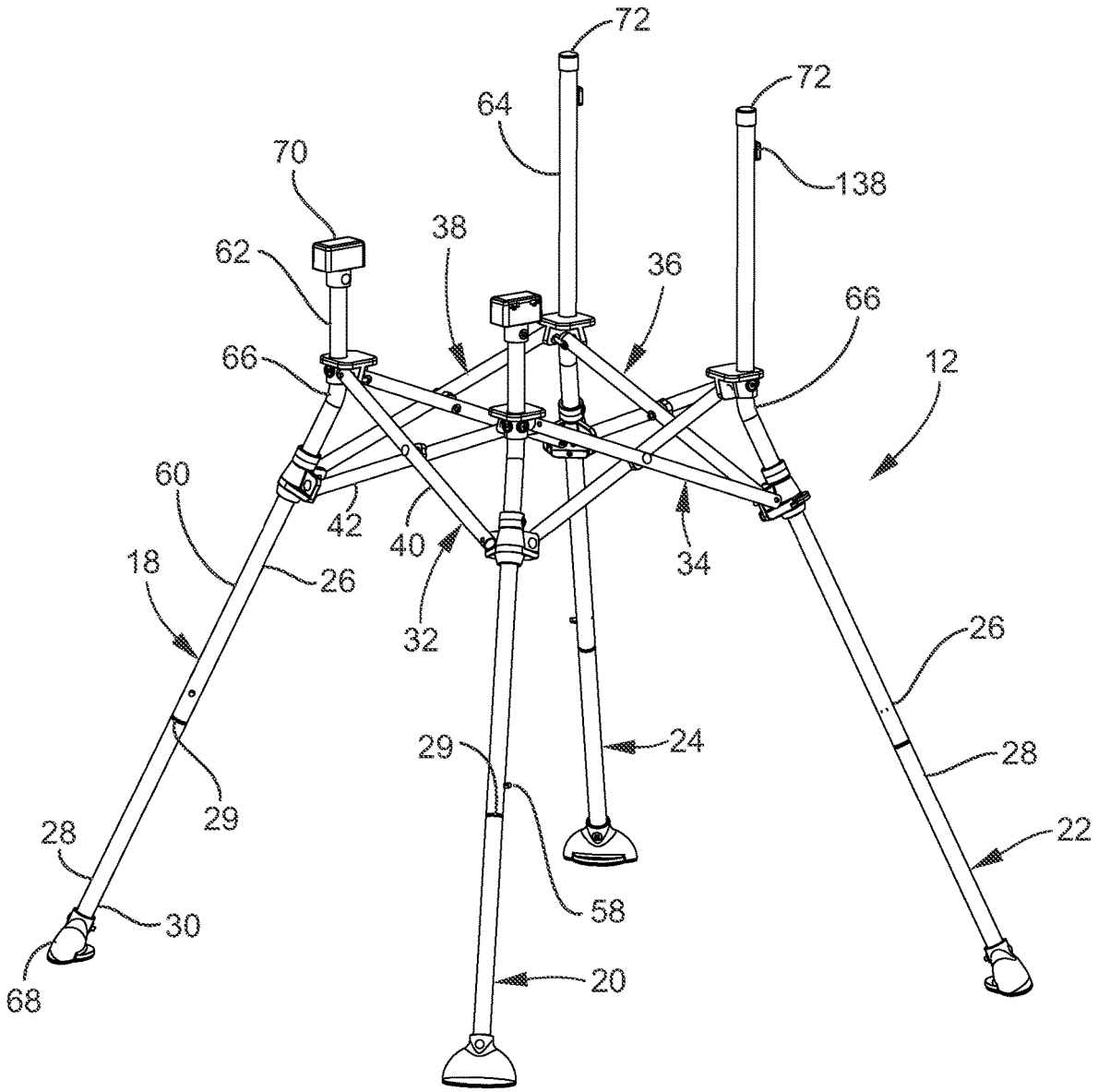
FIG. 1 is a front perspective view of a portion of the frame of the present high chair apparatus, including the first, second, third, and fourth legs, the four sets of cross-supports, and the first, second, third, and fourth feet.
Figure 2:
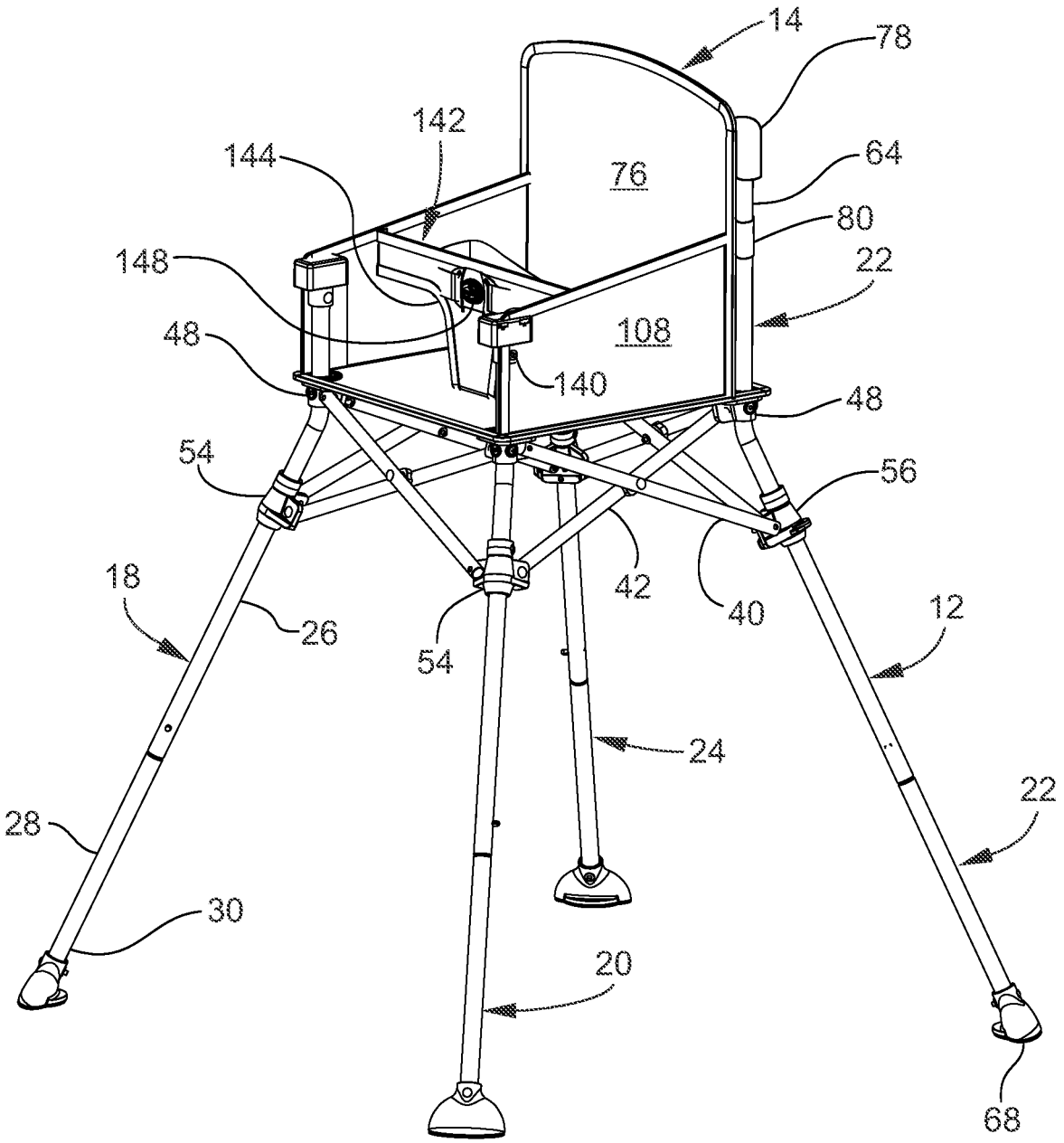
FIG. 2 is a front perspective view of the frame portion of the high chair apparatus of FIG. 1 with the sitting receptacle engaged to the frame portion.
Figure 3:
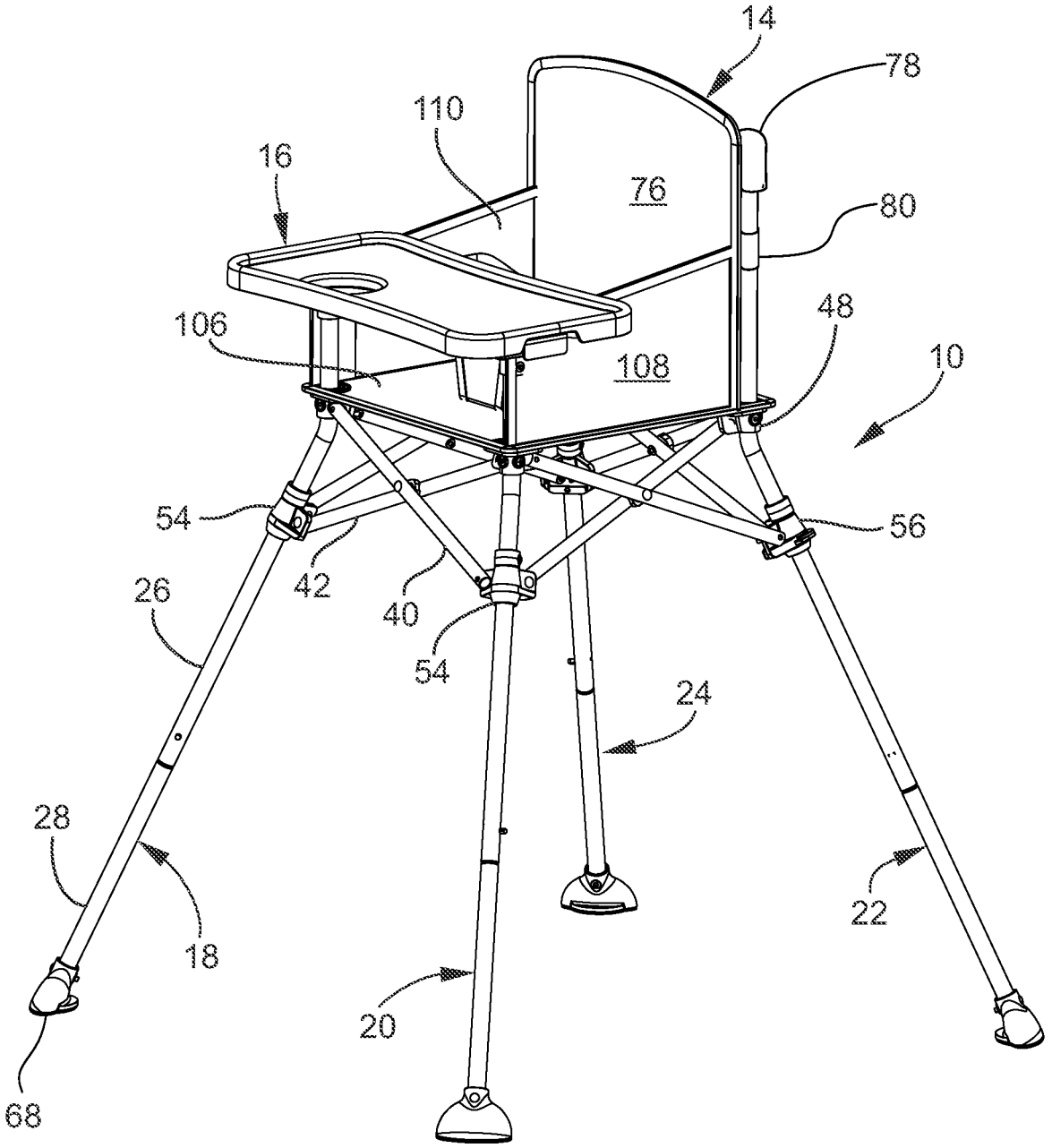
FIG. 3 is a front perspective view of the present high chair apparatus, with the frame portion of the high chair apparatus of FIG. 1 having the sitting receptacle engaged to the frame portion as shown in FIG. 2, and with the frame portion of the high chair apparatus of FIG. 1 further having a rigid tray engaged thereto, where the tray is the final rigid portion of the frame of the high chair apparatus.
Figure 4:
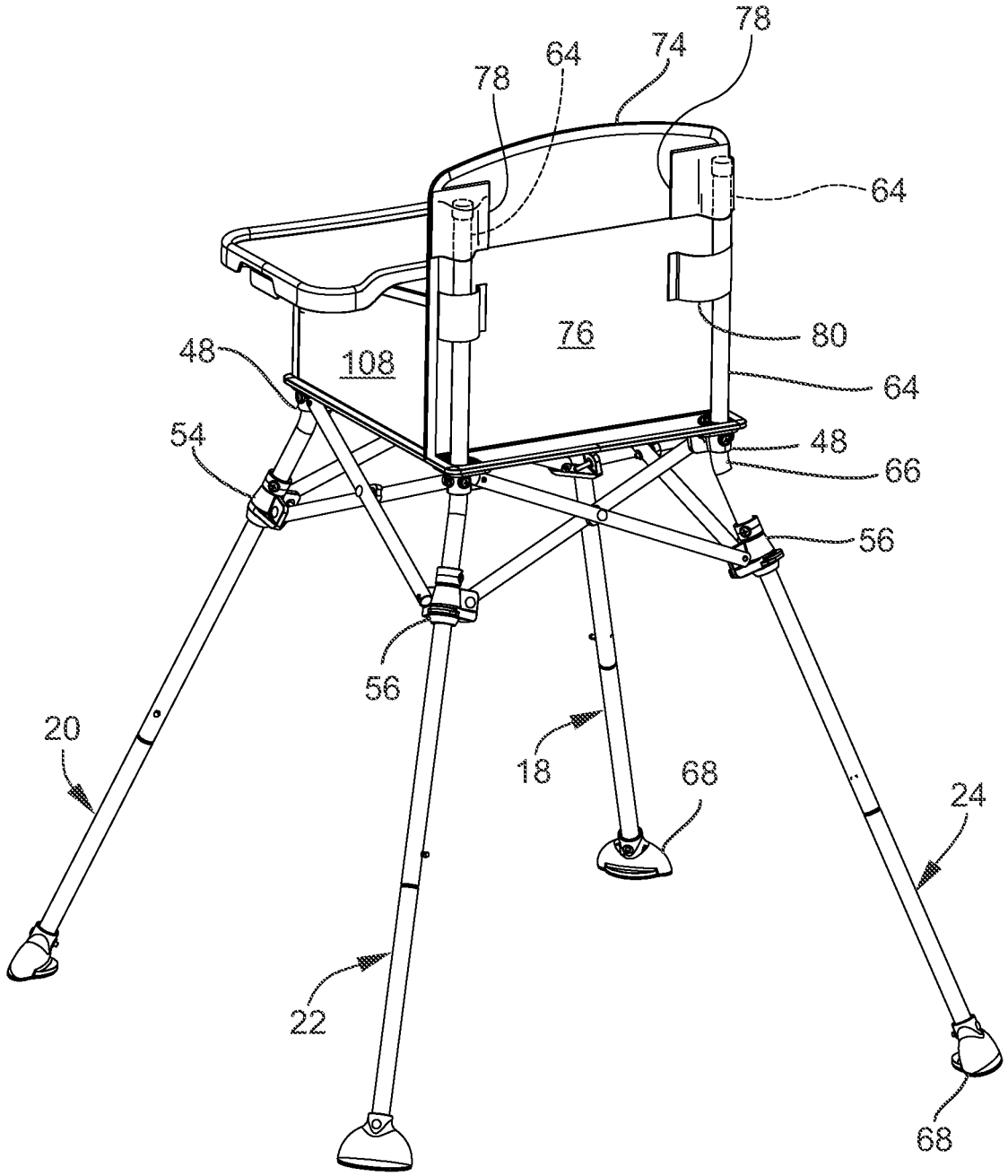
FIG. 4 is a rear perspective of the high chair apparatus of FIG. 3.
Figure 5:
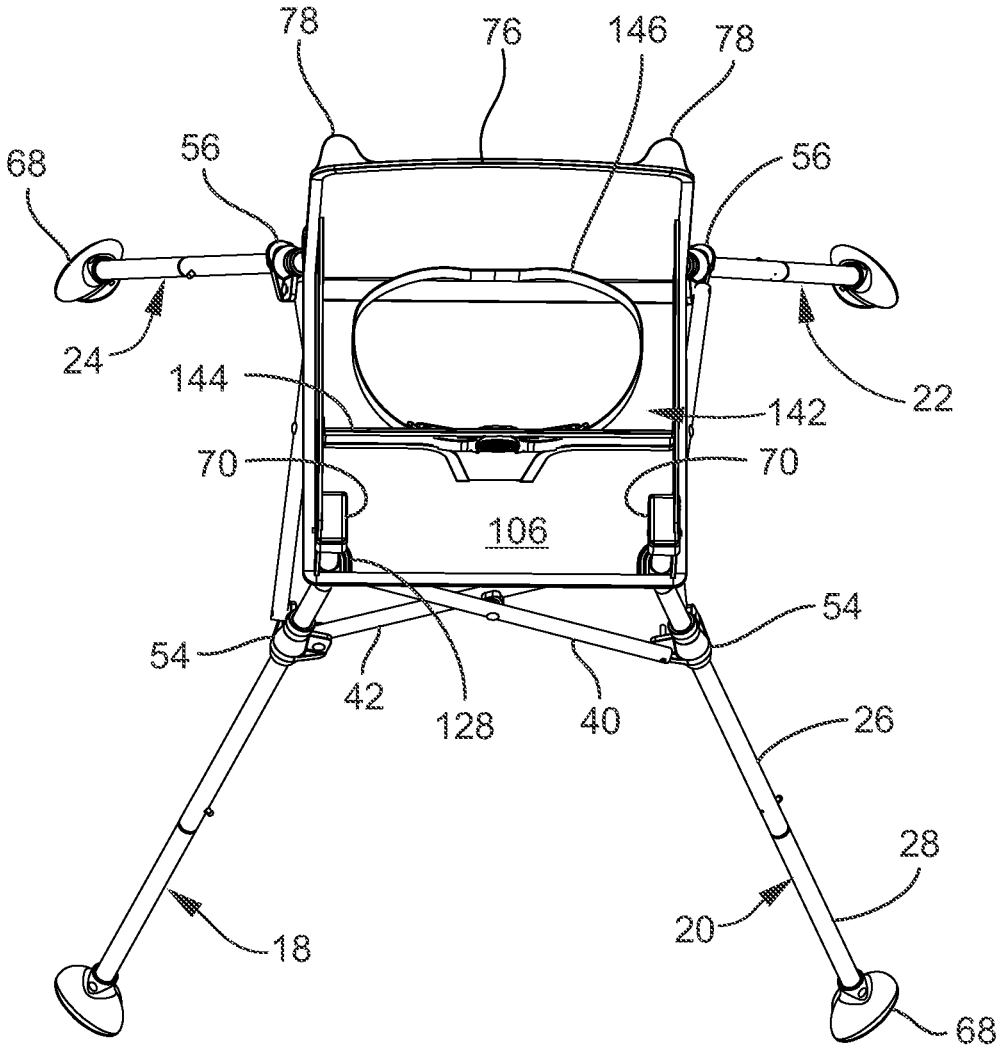
FIG. 5 is a top perspective of the high chair apparatus of FIGS. 3 and 4 where

As shown in FIG. 3, the reference number 10 designates the present high chair apparatus. High chair apparatus 10 includes a frame 12 that is shown in FIG. 1, the frame 12 and a sitting receptacle 14 as shown in FIG. 2, and the frame 12, sitting receptacle 14, and tray 16 as shown in FIG. 3.

The frame 10 includes first, second, third, and fourth legs 18, 20, 22, 24 engaged to the sitting receptacle 14 and supporting the sitting receptacle 14 relative to a floor. Each of the first, second, third, and fourth legs 18, 20, 22, 24 includes an upper leg portion 26 engaging the sitting receptacle 14 and a lower leg portion 28 having a lower or distal end 30. Each of the lower or distal ends 30 is adjacent to the floor.

The first leg 18 is a right front leg and includes a right front upper leg portion 26 and a right front lower leg portion 28. The second leg 20 is a left front leg and includes a left front upper leg portion 26 and a left front lower leg portion 28. The third leg 22 is a left rear leg and includes a left rear upper leg portion 26 and a left rear lower leg portion 28. The fourth leg 24 is a right rear leg and includes a right rear upper leg portion 26 and a right rear lower leg portion 28. The upper leg portion 26 and lower leg portion 28 meet at a junction 29. The lower leg portion 28 runs from the junction 29 downwardly to and through the foot 68 as to each of the legs 18, 20, 22, 24. The upper leg portion 26 runs from the junction 29 upwardly through the sitting receptacle 14 and to the upper ends 70, in the case of front legs 18, 20. As to the rear legs 22, 24, the upper leg portions 26 runs from the junction 29 through the sitting receptacle 14 and to the upper ends 72.

The frame 12 includes first, second, third, and fourth cross-supports 32, 34, 36, 38. Each of the cross-supports 32, 34, 36, 38 include first and second support members 40, 42 pivotally engaged to each other. Each of the first and second support members 40, 42 extend between two adjacent upper leg portions 26 of two adjacent legs 18, 20 or adjacent legs 20, 22, or adjacent legs 22, 24 or adjacent legs 24, 18. Each of the first and second support members 40, 42 includes respective upper ends 44, 46 pivotally engaged to one of said two adjacent upper leg portions 26 via a fixed collar apparatus 48 or location 48. Each of the first and second support members 40, 42 includes respective lower ends 50, 52 pivotally engaged to one of the two adjacent upper leg portions 26 through a nonlockable slideable front collar apparatus 54 or a lockable slideable rear collar apparatus 56.

The first cross-support 32 engages the first and second legs 18, 20. The second cross-support 34 engages the second and third legs 20, 22. The third cross-support 36 engages the third and fourth legs 22, 24. The fourth cross-support 38 engages the fourth and first legs 24, 18.

The first, second, third, and fourth legs 18, 20, 22, 24 have a folded in position where the first, second, third, and fourth legs 18, 20, 22, 24 are adjacent to each other. This folded in position is shown in FIG. 10.

The first, second, third, and fourth legs 18, 20, 22, 24 have a folded out position where the first, second, third, and fourth legs 18, 20, 22, 24 are spaced apart from each other. This folded out position is shown in FIG. 3.

Figure 10:
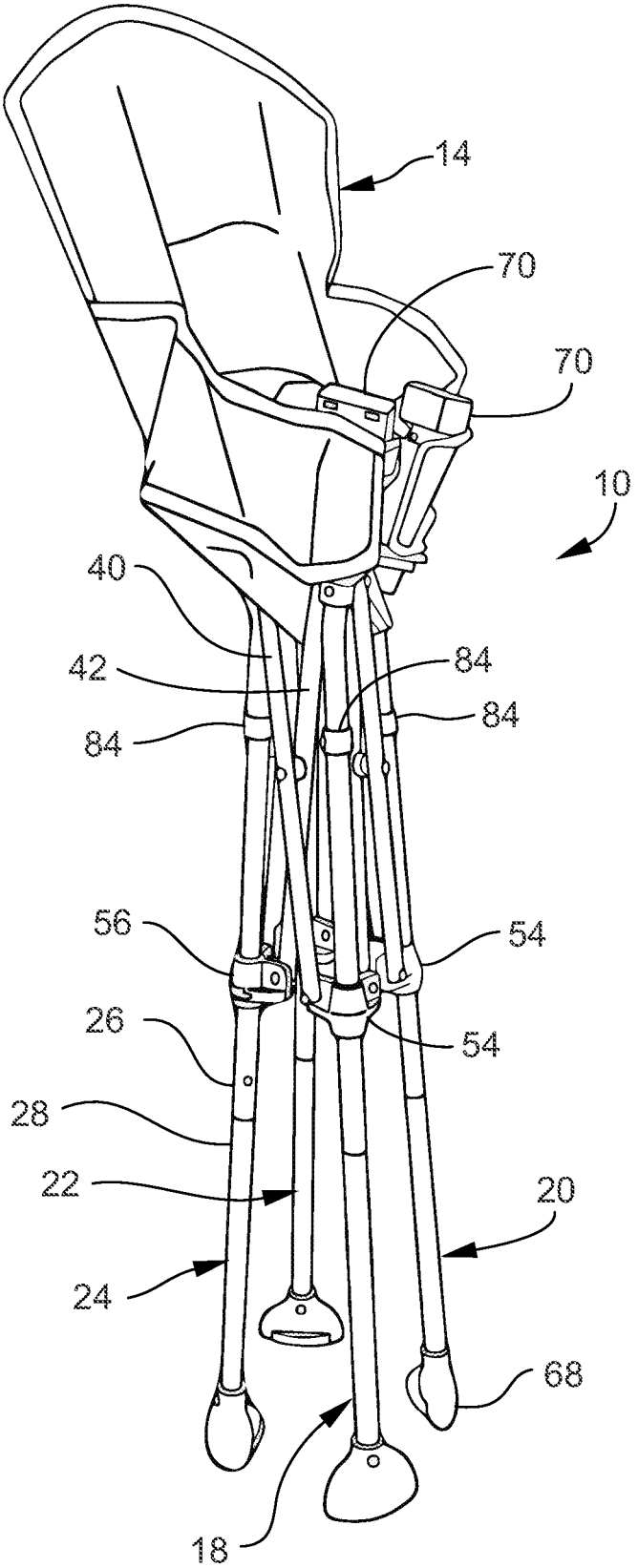
FIG. 10 is a perspective view of the folded in position of the high chair apparatus of FIG. 3, where
Figure 11:
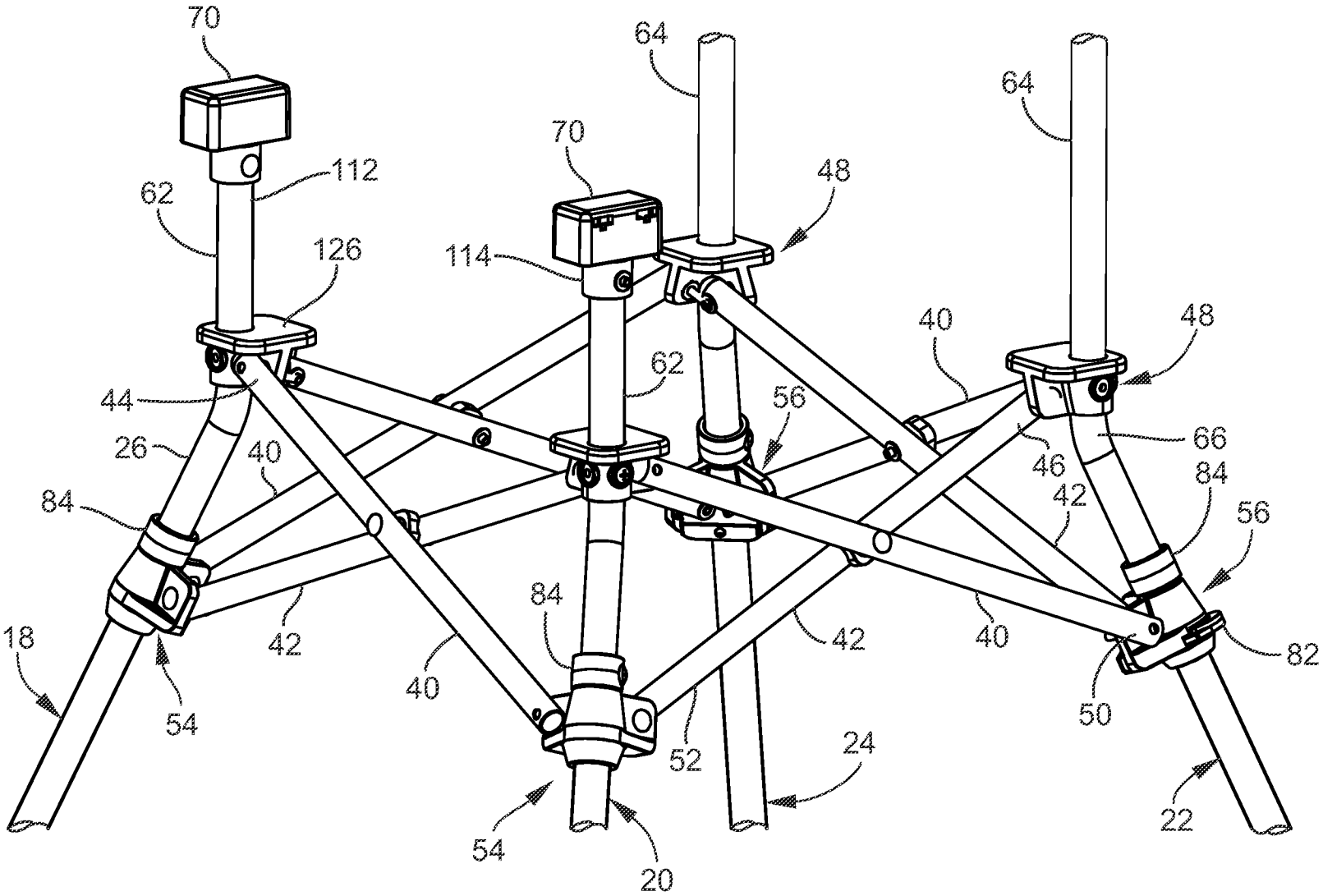
FIG. 11 is a detail perspective front view of the cross-supports.

The first, second, third, and fourth legs 18, 20, 22, 24 are drawable outwardly from the folded in position of FIG. 10 to the folded out position of FIG. 3. The first, second, third, and fourth legs 18, 20, 22, 24 are drawable inwardly from folded out position of FIG. 3 to the folded in position of FIG. 1.

As shown in FIGS. 1, 2, and 3, each of the first, second, third, and fourth legs 18, 20, 22, 24 in the folded out position extend further apart incrementally from each of the other first, second, third, and fourth legs 18, 20, 22, 24 from the upper collar apparatus 48 or location 48 to the lower or distal end 30 of each of the first, second, third, and fourth legs 18, 20, 22, 24 such that each of the first, second, third, and fourth legs 18, 20, 22, 24 begins to extend outwardly at such upper collar apparatus 48 or location 48 and continuously maintains an outward extension to the lower or distal end 30 of each of the first, second, third, and fourth legs 18, 20, 22, 24 such that the first, second, third, and fourth legs 18, 20, 22, 24 provide a wide base for the sitting receptacle 14 and for the high chair apparatus 10 as a whole.

Each of the first, second, third, and fourth legs 18, 20, 22, 24 is tubular such that each of the upper leg portions 26 is tubular and such that each of the lower leg portions 28 are tubular. Each of the support members 40, 42 of each of the cross-supports 32, 34, 36, 38 is tubular.

Figure 6B:
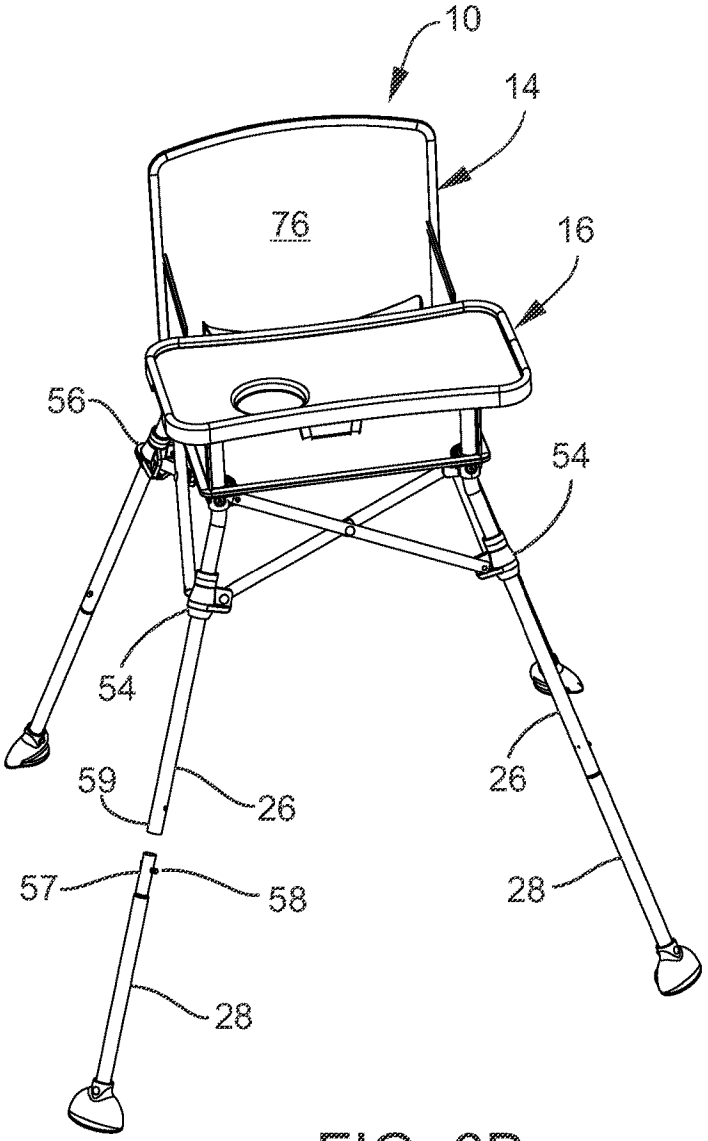
FIG. 6B shows the right front lower leg portion disengaged from the right front upper leg portion and shows the other lower leg portions engaged to their respective upper leg portions.
Figure 6A:
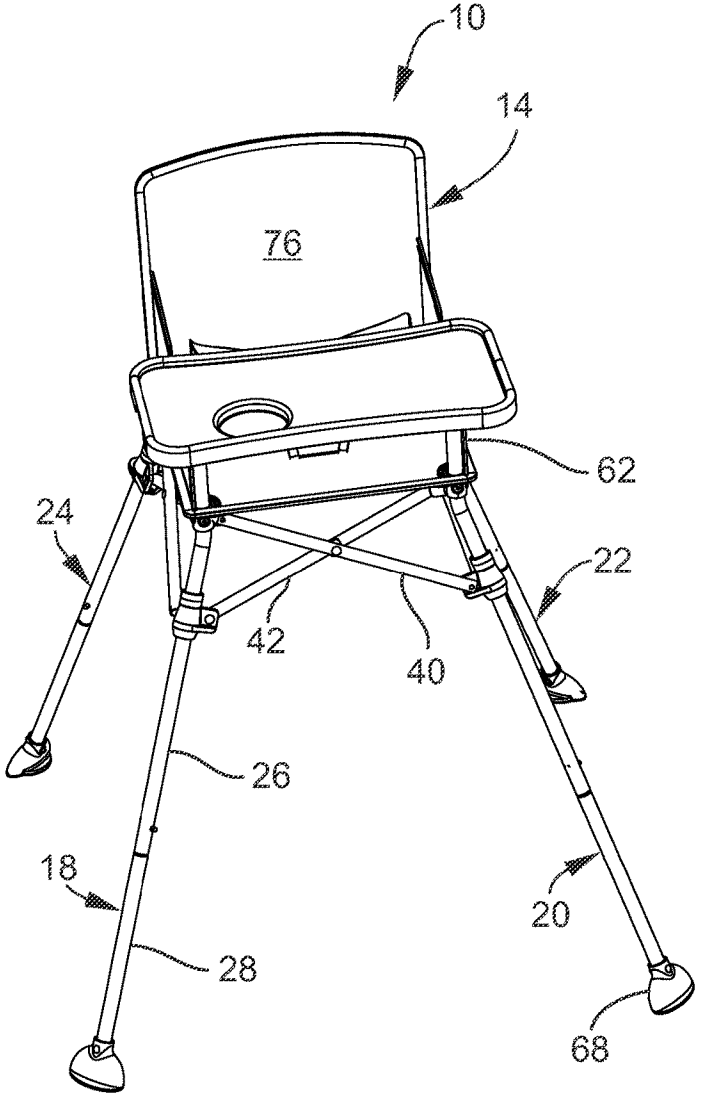
FIG. 6A is a front perspective of the high chair apparatus of FIG. 3 having all four of the lower leg portions engaged to the upper leg portions.
Figure 7B:
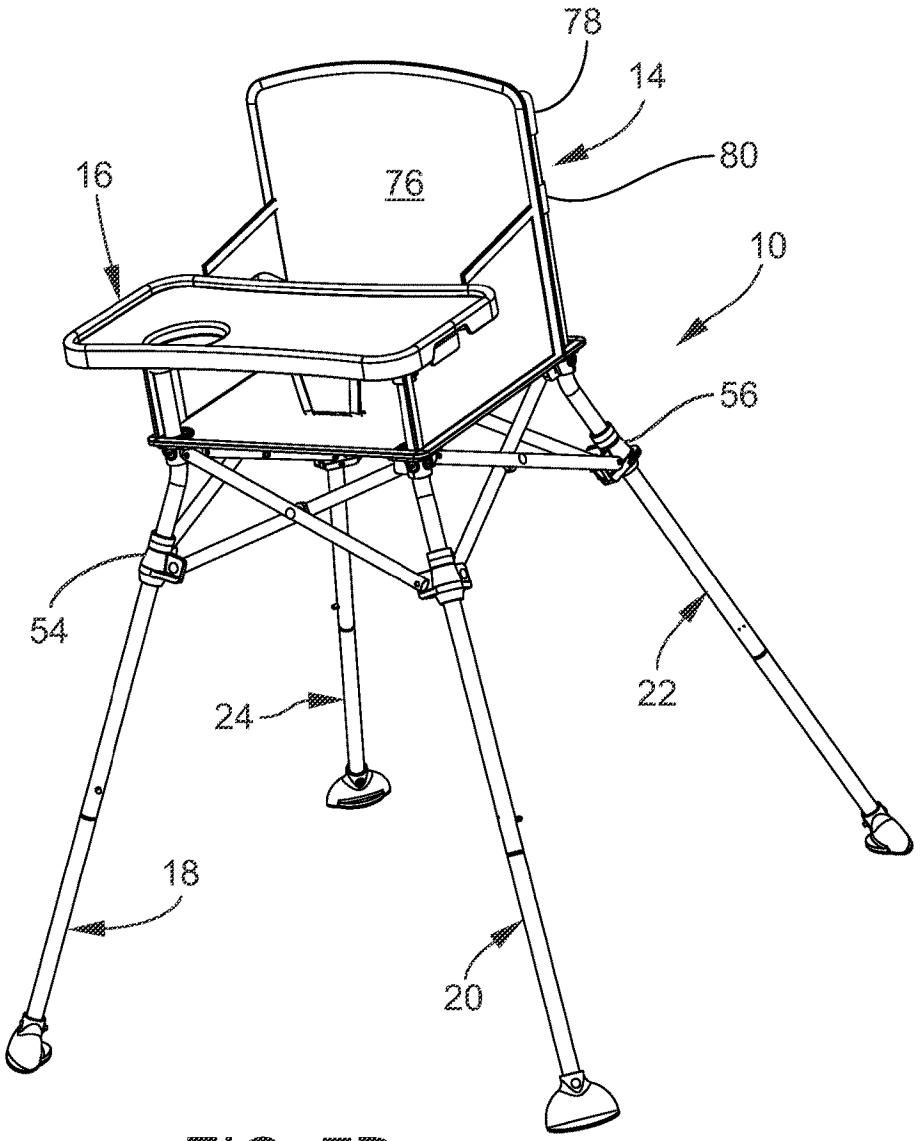
FIG. 7B is a front perspective of the high chair apparatus of FIG. 3 provided for reference as to where the collar of FIG. 7A is located on the high chair apparatus.
Figure 7A:
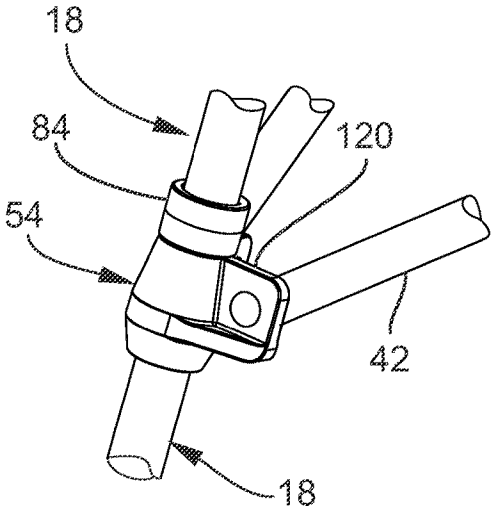
FIG. 7A is a detail perspective view of a front lower slideable and nonlockable collar of the front right leg.
Figure 8B:
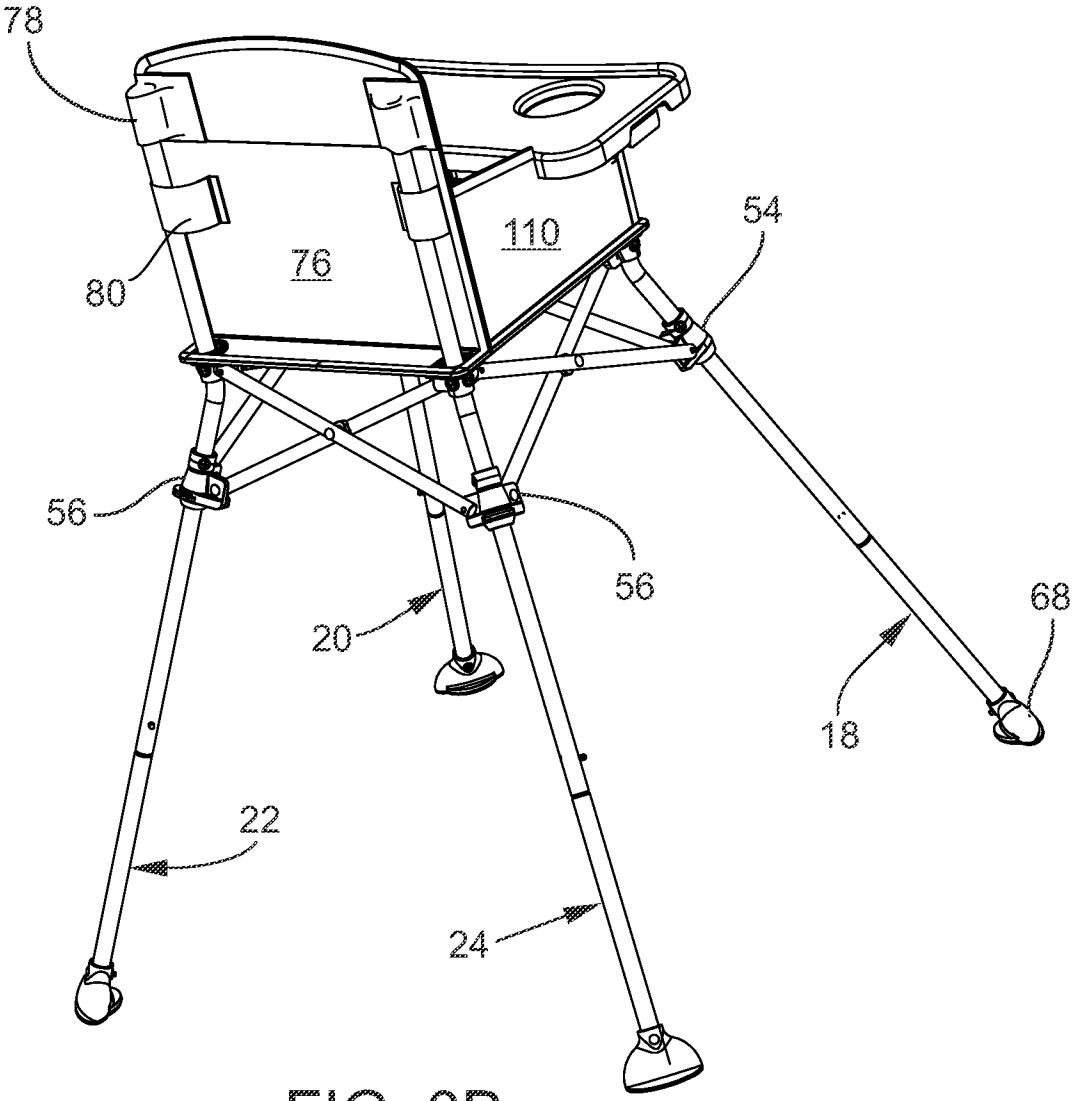
FIG. 8B is a rear perspective of the high chair apparatus of FIG. 3 provided for reference as to where the collar of FIG. 8A is located on the high chair apparatus.
Figure 8A:
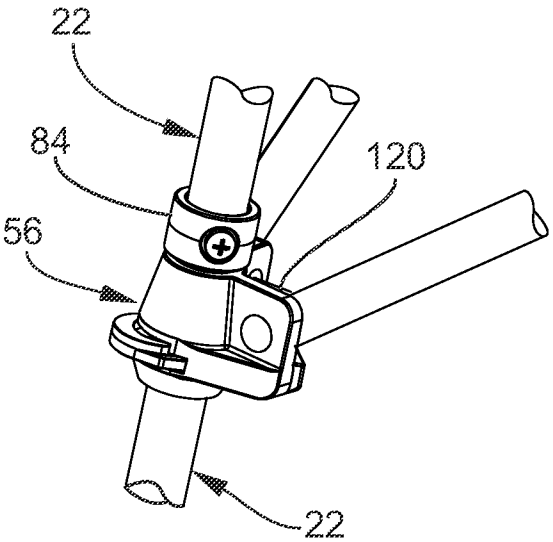
FIG. 8A is a detail perspective view of a rear lower slideable and lockable collar of the rear left leg.
Figure 9C:
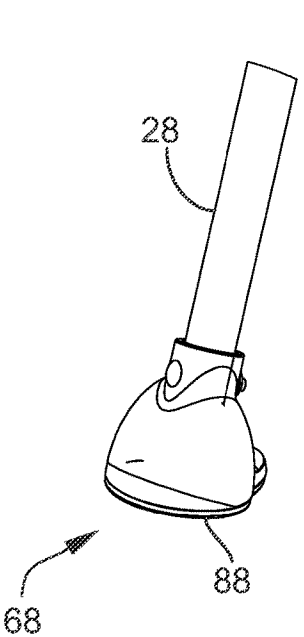
FIG. 9C is a front perspective view of the foot of FIG. 9A.
Figure 9F:
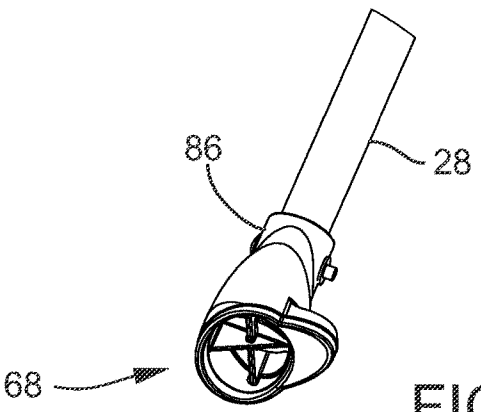
FIG. 9F is a bottom perspective view of the foot of FIG. 9A.
Figure 9B:
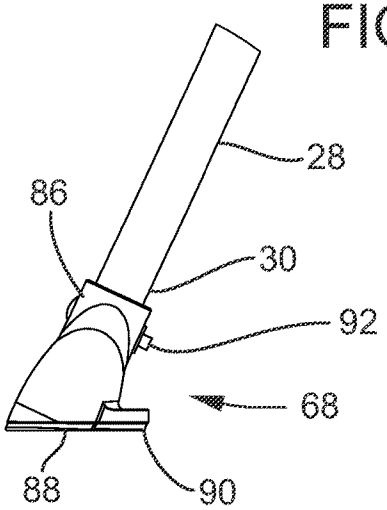
FIG. 9B is a side elevation view of the foot of FIG. 9A.
Figure 9E:
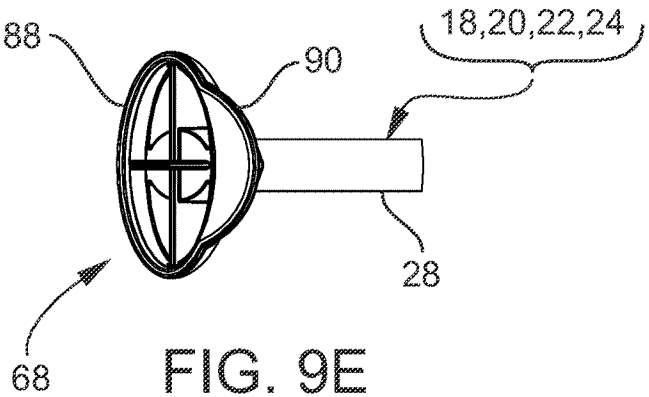
FIG. 9E is a bottom front on view of the foot of FIG. 9A taken as if one is looking at the foot upwardly through a glass floor directly under the foot plant of the foot.
Figure 9A:
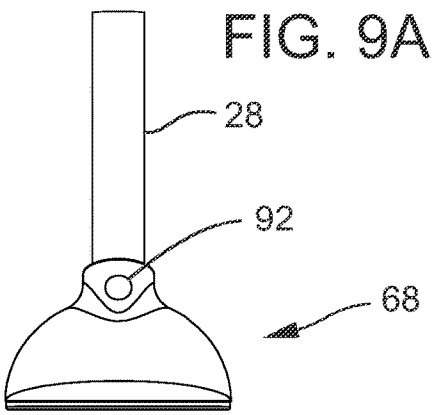
FIG. 9A is a front elevation view of the foot engaged on the distal end of one of the first, second, third, and fourth legs.
Figure 9D:
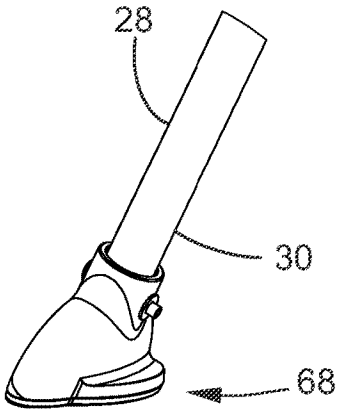
FIG. 9D is a rear perspective view of the foot of FIG. 9A.

Upper leg portion 26 is removably engageable to the lower leg portion 28. Lower leg portion 28 includes a male upper end section 57, as shown in FIG. 6B. Upper leg portion 26 includes a female lower end section 59. A spring biased button 58 disposed inside of the tubular male upper end section of the lower leg portion 28 extends through an opening in the male upper end section 57 and then extends through an aligned opening in the female lower end section 59 of upper leg portion 26. The outside diameter of the male upper end section 57 of lower leg portion 28 is about equal to or slightly less than the inside diameter of the female lower end section 59 of upper leg portion 26 to maximize rigidity and minimize wobble between the lower leg portion 28 and upper leg portion 26.

The upper leg portion 26 includes a first elongate straight portion 60 that includes a first straight axis and a second elongate straight portion 62 or 64 that includes a second straight axis. The first and second straight axis are oblique to each other. First and second front legs 18, 20 include second elongate portion 62. Third and fourth rear legs 22, 24 include second elongate portion 64.

Upper leg portion 26 further includes a transition or curved portion 66 integrally disposed between the first elongate straight portion 60 and the second elongate straight portion 62, as to the front legs 18, 20. Upper leg portion 26 also includes transition or curved portion 66 integrally disposed between the first elongate straight portion 60 and the second elongate straight portion 64, as to the rear legs 22, 24. Collar apparatus 48 is fixed to its respective second elongate straight portion 62 or 64 immediately above the top of the transition or curved portion 66. The set of four collar apparatus 48 defines a plane and the first, second, third, and fourth legs 18, 20, 22, 24 begin to extend away from each other at a location immediately at or immediately below this plane by the transition or curved portions 66 extending away from each other. Beginning such an extension away from each other as early as possible from the sitting receptacle 14 maximizes the foot plant or maximizes the base provided by feet 68 engaged to the distal ends 30 of the legs 18, 20, 22, 24.

As to the first and second legs 18, 20, first elongate straight portion 60, front elongate portion 62, and transition or curved portion 66 is integral, one-piece and tubular. As to the third and fourth legs 22, 24, first elongate straight portion 60, rear elongate portion 64, and transition or curved portion 66 is integral, one-piece, and tubular.

The lower or distal ends of the first, second, third, and fourth legs 18, 20, 22, 24 define a plane. The straight axis of the straight lower leg portion 28 is oblique to such plane. The straight axis of the lower elongate straight portion 60 of the upper leg portion 26 is also oblique to such plane and is aligned with and in line with the straight axis of the lower leg portion 28. The upper elongate straight front portions 62 of the first and second legs 18, 20 includes a straight axis that is at a right angle to such plane or is at generally a right angle to such plane. The upper elongate straight rear portions 64 of the third and fourth legs 22, 24 includes a straight axis that is at a right angle to such plane or is at generally a right angle to such plane.

Each of said first, second, third, and fourth legs 18, 20, 22, 24 tapers downwardly and outwardly from the bottom of the upper collar 48 and adjacent to where the upper ends 44, 46 of the first and second support members 40, 42 are pivotally engaged to one of two adjacent upper leg portions 26. Each of said first, second, third, and fourth legs 18, 20, 22, 24 extends upright or generally upright from the bottom of the upper collar apparatus 48 such that the upper collar apparatus 48 has a vertical axis.

The right front leg 18 includes a right front uppermost end 70. The left front leg 20 includes a left front uppermost end 70. The right rear leg 22 includes a right rear uppermost end 72. The left rear leg 24 includes a left rear uppermost end 72. The right rear and left rear uppermost ends 72 are disposed at a greater distance from the location 48, or from the bottom of the respective upper collar apparatus 48 than are the right front and left front uppermost ends 70. The right front and left front uppermost ends 70 engage the tray 16, specifically the bottom of the tray 16. The right rear and left rear uppermost ends 72 terminate adjacent to an upper edge 74 of a back 76 of the sitting receptacle 14. The rear upper elongate portions 64 have the upper ends 72. The rear upper elongate portions 64 run or extend adjacent to an outside surface of the back 76 of the sitting receptacle 14. Uppermost ends 72 are captured or engaged in pockets 78 stitched to the back 76 of the sitting receptacle. Each of the pockets 78 includes an open bottom into which the uppermost ends 72 are first slid for engagement in the pockets 78. Further stitched to the back 76 of the sitting receptacle 14 are a pair of half-loops 80 that engage an intermediate section of each of the rear upper elongate portions 64.

Each of the first, second, third, and fourth legs 18, 20, 22, 24 includes an upper collar apparatus 48. Each of first and second legs 18, 20 includes a lower collar apparatus 54. Each of the third and fourth legs 22, 24 includes a lower collar apparatus 56. Upper collar apparatus 48 engages two upper ends 44, 46 of two adjacent cross supports 32, 34, 36, 38. Each of the lower collar apparatus 54, 56 engages two lower ends 50, 52 of two adjacent cross supports 32, 34, 36, 38. Upper collar apparatus 48 includes an upper axis. Each of the lower collar apparatus 54, 56 includes a lower axis. The upper axis of the upper collar apparatus 48 is oblique to the axis of its respective lower collar apparatus 54, 56 that is disposed on the upper elongate upper portion 64.

The upper collar apparatus 48 is fixed at the location 48 such that the bottom of the upper collar apparatus 48 is aligned with the integral junction between transition or bend 66 and the upper elongate portion 62 on the first and second front legs 18, 20 or the upper elongate portion 64 on the third and fourth rear legs 22, 24. The lower collar apparatus 54, 56 are slideable on the legs 18, 20, 22, 24 such that the cross-supports 32, 34, 36, 38 scissor as the lower collar apparatus 54, 56 slides down the legs 18, 20, 22, 24 as the first, second, third, and fourth legs 18, 20, 22, 24 are drawn inwardly from the folded out position to the folded in position. The rear lower collar apparatus 56 of each of the third and fourth legs 22, 24 is lockable to its respective third and fourth legs 22, 24 when the first, second, third, and fourth legs 18, 20, 22, 24 are in the folded out position by an inner pin of the spring based member 82 of the rear lower collar apparatus 56 engaging a hole in each of the third and fourth rear legs 22, 24.

The front lower collar apparatus 54 of each of the first and second legs 18, 20 is free to slide when the first, second, third, and fourth legs 18, 20, 22, 24 are in the folded out position, when the first, second, third, and fourth legs 18, 20, 22, 24 are in the folded in position, and when the first, second, third, and fourth legs 18, 20, 22, 24 are in any position between the folded out and folded in positions.

Each of the first, second, third, and fourth legs 18, 20, 22, 24 includes a stop 84 engaged thereto and disposed immediately adjacent to the lower collar apparatus 54, 56 when the first, second, third, and fourth legs 18, 20, 22, 24 are in the folded out position. The stop 84 is disposed between the lower collar apparatus 54 or 56 and the sitting receptacle 14. Stop 84 is an annular or ring stop 84 fixed to its respective leg 18, 20, 22, 24 with a pin connector radially engaging the ring stop 84 and further engaging one of the legs 18, 20, 22, 24.

The high chair apparatus 10 includes first, second, third, and fourth feet 68 engaged respectively to the first, second, third, and fourth legs 18, 20, 22, 24 at the lower or distal end 30. The foot 68 includes a receptacle 86 for the lower or distal end 30. The receptacle 86 includes an axis and is coaxial with the lower end 30 and the lower leg portion 28. Foot 68 includes a bottom 88 that makes direct contact with the floor. Bottom 88 defines a plane that engages the floor and that is oblique relative to the axis of the receptacle 86. Bottom 88 includes an elliptical shape and further includes a semi-circular shape that is provided by an ear 90 such that the foot plant that makes contact with the floor includes a full ellipse and a semi-circular shape. Ear 90 extends inwardly toward a vertical central axis defined by the four elongate upper portions 62, 64, where the central axis extends equidistance from and parallel to each of the four vertical axis of the four elongate upper portions 62, 64. Ear 90 is an integral and one-piece portion of each of the feet 68. Foot 68 is removably engaged to lower or distal end 30 by a pin 92. Foot 68 includes internal plate or plate like supports 92, 94. Plates 92, 94 are integral and one-piece with foot 68. Plates 92, 94 extend at a right angle to each other. The bottom edges of plates 92, 94 are spaced from bottom 88 and thus are spaced from the floor. Plate 92 runs vertically and defines a plane that includes the central axis defined by the four vertical axis of the four elongate upper portions 62, 64 such that plane 92 runs from an outside edge of a body 98 of foot 68 to an inside edge of body 98, where the inside edge of body 98 transitions into the ear 90. Body 98 extends, from receptacle 86, outwardly, inwardly, and sideways so as to provide a larger foot plant than either would the receptacle 86 or lower end 30. Plate 94 integrally engages body 98, receptacle 86, and plate 92. Plate 94 extends between body 98 and receptacle 86. Plate 92 extends between the body 98 and plate 94. The elliptical portion of the bottom 88 is open. The ear portion or semi-circular portion of the bottom 88 is closed. Ear 90 includes a bottom ear shaped or semi-circular shaped solid portion 100 that is co-planar with the elliptical portion of bottom 88. Plate 92 includes an upper edge 102. Plate 94 includes a U-shaped cut-out with an upper edge 104. Upper edges 102, 104 form an X-shape for supporting and abutting the circular bottom edge of lower end 30.

The locations 48, or the bottoms of the upper collar apparatus 48, of the first, second, third, and fourth legs 18, 20, 22, 24 define a plane when the first, second, third, and fourth legs 18, 20, 22, 24 are in the folded out position. Lower leg portions 28 are straight. Each of the lower leg portions 28 is disposed at an oblique angle relative to such plane. Such oblique angles are identical. Foot 68 includes receptacle 86 for the lower end 30 of the legs 18, 20, 22, 24. The receptacle 86 includes an axis and is coaxial with the lower end 30 and lower leg portion 28. Foot 68 includes the bottom 88. The bottom 88 defines a plane that engages the floor and that is disposed at an oblique angle relative to the axis of the receptacle 86. Each of the feet 68 is interchangeable with any one of the other feet 68.

Sitting receptacle 14 is flexible. Sitting receptacle 14 includes a seat 106, the back 76, a left side 108, and a right side 110. Each of the seat 106, back 76, left side 108, and right side 110 is formed of a flexible material. The seat 106 is engaged to each of the back 76, left side 108, and right side 110. The back 76 is engaged to each of the seat 106, left side 108, and right side 110. The right side 110 is engaged to each of the seat 106 and back 76. The left side 108 is engaged to each of the seat 106 and back 76.

The high chair apparatus 10 includes the frame 12. The frame 12 includes the first, second, third, and fourth legs 18, 20, 22, and 24. The frame 12 further includes the tray 16. Tray 16 is engaged to the first and second legs 18, 20, specifically to the box like ends 70 or block ends 70 or parallelepiped upper ends 70 of the first and second legs 18, 20. The tray 16 includes a rigid material that spaces apart the first and second legs 18, 20 when the first, second, third, and fourth legs 18, 20, 22, 24 are in the folded out position. Along with the rear collar apparatus 56 and its locking member 82 and the stops 84, the tray 16 holds the first, second, third, and fourth legs 18, 20, 22, and 24 in the folded out position. The tray 16 is removable from the first and second legs 18, 20. On its underside, the tray 16 includes rectangular receptacles for the upper ends 70. Each of the upper ends 70 is engaged to a tubular upper end 112 of legs 18, 20 through an integral cylindrical receptacle 114 that is pinned to the tubular upper end 112. The tray 16 when engaged to the first and second legs 18, 20 prevents the first, second, third, and fourth legs 18, 20, 22, 24 from being folded from the folded out position to the folded in position. The first, second, third, and fourth legs 18, 20, 22, 24 are foldable from the folded out position to the folded in position when the tray 16 is disengaged from the first and second legs 18, 20 and when the spring biased members 82 are unlocked from the rear legs 22, 24.

FIGS. 15A, 15B, 15C, and 15D show the upper collar apparatus 48. Upper collar apparatus 48 is integral and one-piece. Upper collar apparatus 48 includes an annular collar 116 that surrounds its respective leg 18, 20, 22, or 24 and is fixed to such leg with a pair of pin connectors 118. Extending from the collar 116 are a pair of ears 120 extending transversely to each other. The ears 120 serve as mounts for the upper ends 44 of the support members 40, 42 or specifically for pin connectors 122 for engaging the upper ends 44 of the support members 40, 42 to the ears 120. Pin connector 122 extends diametrically through the upper end 44. A pin 124 extends from an ear 120 to serve as a mount for pin connector 122 for the upper end 44 for support member 42. There is no pin mount 124 for support member 40. Upper collar apparatus 48 further includes an integral platform 126 for supporting or serving as a mount for a grommet 128 of the seat 106 of sitting receptacle 14. Ears 120 extend down from platform 126 and extend radially from collar 116. Platform 126 includes a through hole that is coaxial with the collar 116 for permitting one of the legs 18, 20, 22, 24 to extend therethrough. Hole 130 is formed in a corner portion of platform 126. Hole 130 is offset from the center of platform 126. Ears 120 have sufficient height to permit the support members 40, 42 to pivot substantially vertically such that the upper ends 44 clear the bottom of the platform 126 as the support members 40, 42 pivot from the folded out position of the legs 18, 20, 22, 24 to the folded in position of the legs 18, 20, 22, 24.

Lower front collar apparatus 54 is shown in FIGS. 16A and 16B and lower rear collar apparatus 56 is shown in FIGS. 16C and 16D. Each of the lower front and rear collar apparatus 54, 56 includes an annular integral collar 132 that surrounds its respective leg 18 or 20. The top of collar 132 abuts the bottom of stop 84 when the legs 18, 20, 22, 24 are in the folded out position. Stops 84 prevent the lower front and rear collar apparatus 54, 56 from sliding further upwardly and hold the legs 18, 20, 22, 24 in the folded out position. A pair of ears 120 extend integrally from collar 132 for mounting the lower ends 46 of the first and second support members 40, 42 with radially extending pin connectors 122. Each of the lower front and rear collar apparatus 54, 56 includes an integral base 134 and an integral frustoconical portion 136 extending downwardly from the base 134. Ears 120 extend integrally from base 134. In the case of lower rear collar apparatus 56, base 134 houses the spring biased member 82 that automatically snaps into a hole formed in rear legs 22, 24 when the legs 18, 20, 22, 24 have been fully folded out to where the stops 84 are engaged by the rear collars 132. When the high chair apparatus 10 is to be folded to the folded in position, the disk like edges of members 82 are pulled out to disengage an inner pin member from holes in the rear legs 22, 24.

The sitting receptacle 14 may be engaged to the frame 12 or legs 18, 20, 22, 24 in several ways. For example, back 76 may be engaged to legs 22, 24 or elongate portions 64 by the loops 80 and pockets 78. Or, as shown in FIG. 1, the frame 12, particularly the front upper elongate portions 62 of front legs 18 and 20 and the rear upper elongate portions 64 of rear legs 22, 24, may include a number of plastic washers, such as plastic washer 138 in FIG. 1, that serve as a base for a pin connector 140 such as a headed screw that engages the sitting receptacle 14 such as the back 76 of the sitting receptacle 14. The pin connector 140 that is shown in FIG. 1 engages a plastic washer engaged to the cylindrical receptacle 114 of the block 70 or uppermost front end 70 of leg 20. Or a combination of both methods may be used. For example, the rear elongate portions 64 may be inserted in pockets 78 and then pin connector 140 may be engaged first with pocket 78 and then with the plastic washer 138.

Sitting receptacle 14 includes a flexible safety harness 142 for the child. Safety harness 142 includes an flexible T-shaped portion 144 engaged to the seat 106, left side 108, and right side 110 and a flexible mid-section wrap 146 engaged to the T-shaped portion 144 and to the back 76. The mid-section wrap 146 extends about the mid-section of a child. The T-shaped portion 144 extends across the mid-section of a child and between the legs of a child. Safety harness 142 further includes a buckle 146 that engages and disengages the mid-section wrap 146 to and from the T-shaped portion 144 and that further can draw the mid-section wrap relatively tightly or relatively loosely. T-shaped portion 144 is preferably stitched permanently in place to the seat 106 and sides 108, 110.

Figure 12:
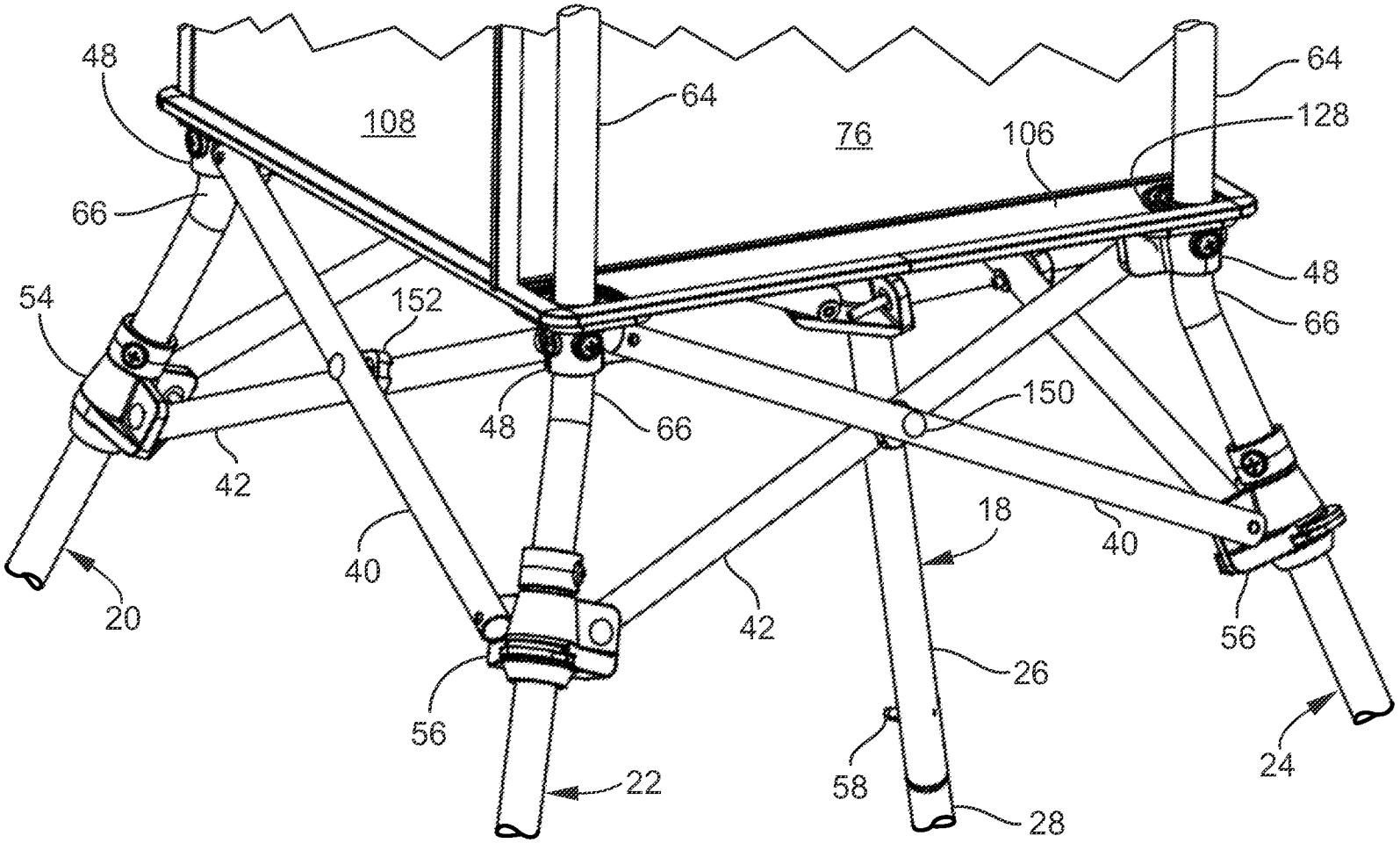
FIG. 12 is a detail perspective rear view of the cross-supports.
Figure 13:
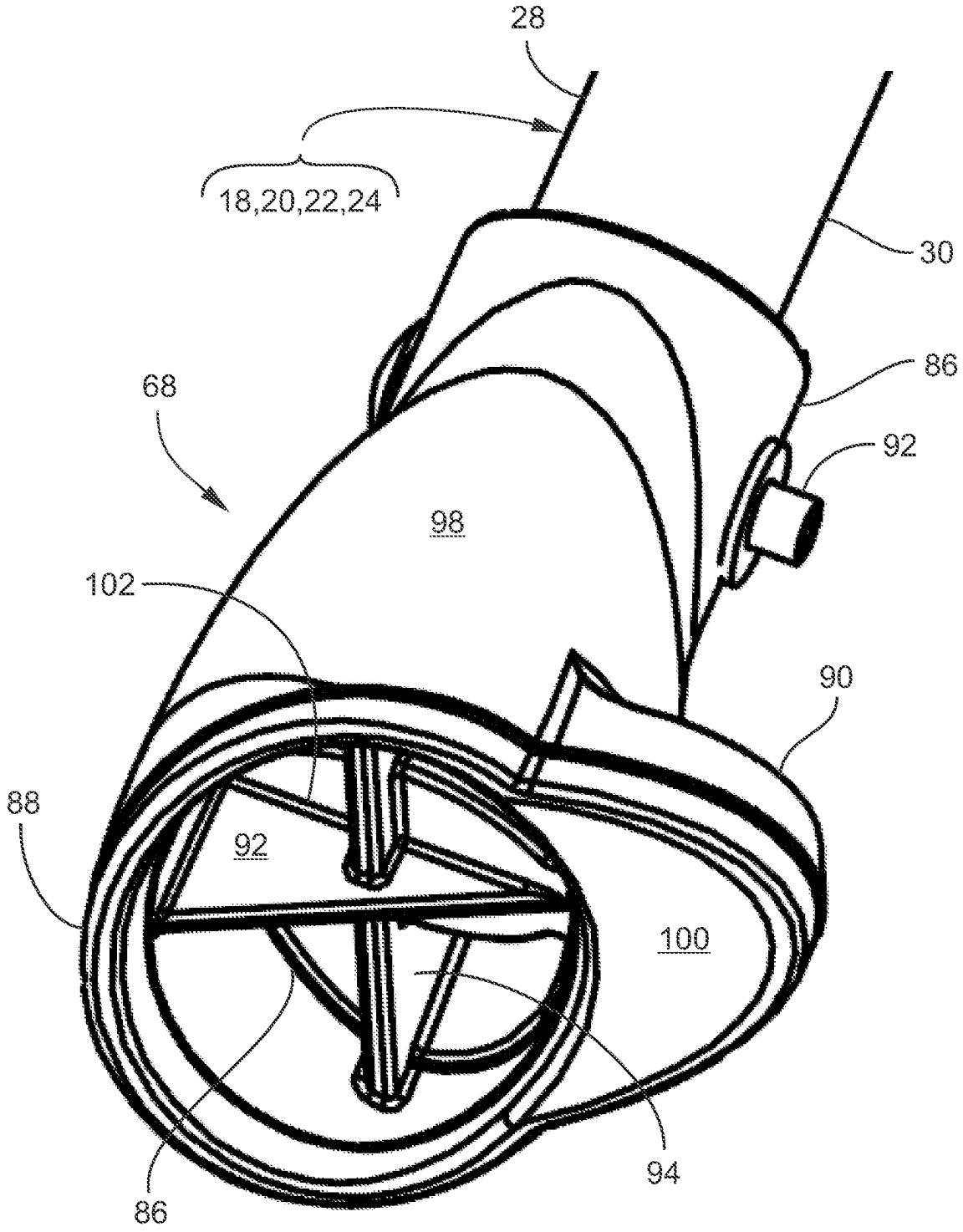
FIG. 13 is a detail perspective view of the bottom of the foot of each of the legs of the high chair apparatus of FIG. 1.
Figure 14:
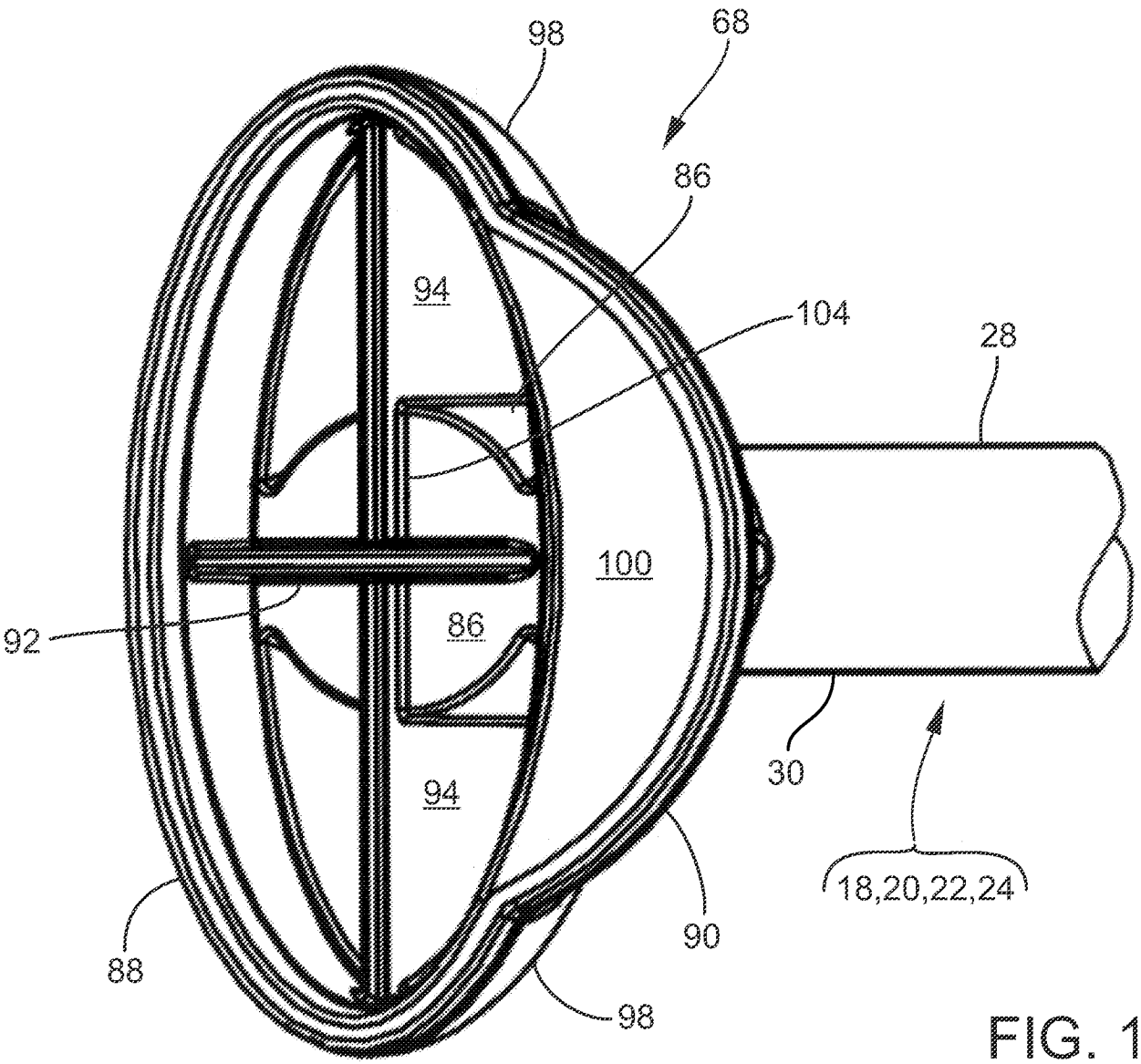
FIG. 14 is a detail plan view of the bottom of the foot of FIG. 13.
Figure 15A:
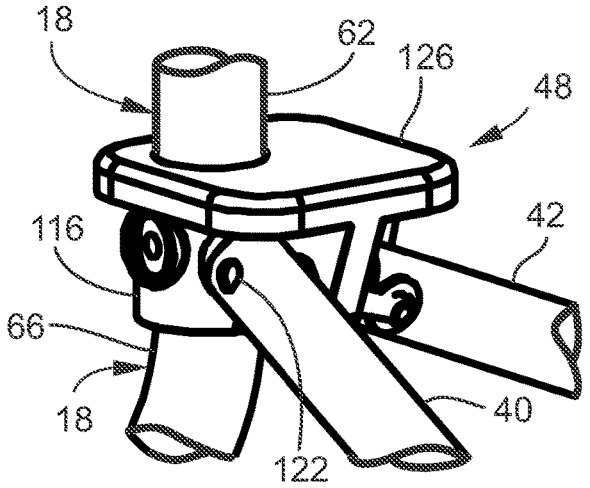
FIG. 15A is a perspective view of the upper collar apparatus on the right front leg of the high chair apparatus of FIG. 1.
Figure 15B:
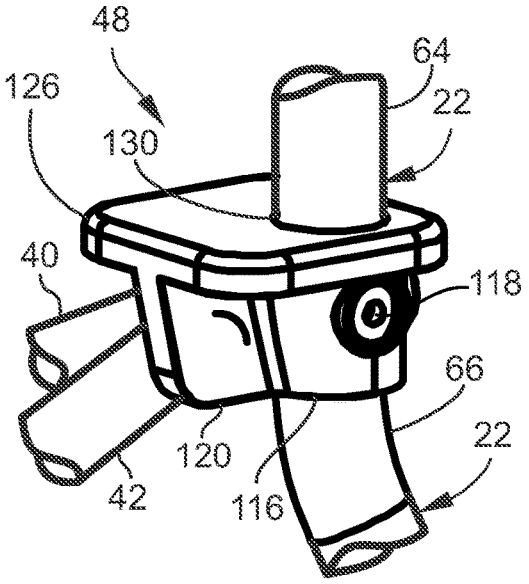
FIG. 15B is a perspective view of the upper collar apparatus on the left rear leg of the high chair apparatus of FIG. 1.
Figure 15C:
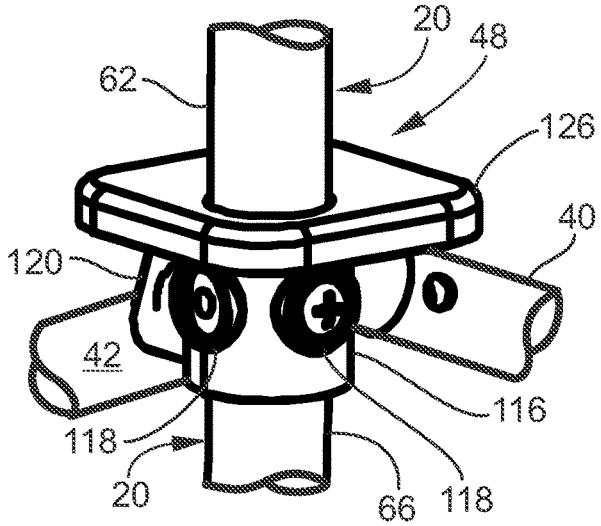
FIG. 15C is a perspective view of the upper collar apparatus on the left front leg of the high chair apparatus of FIG. 1.
Figure 15D:
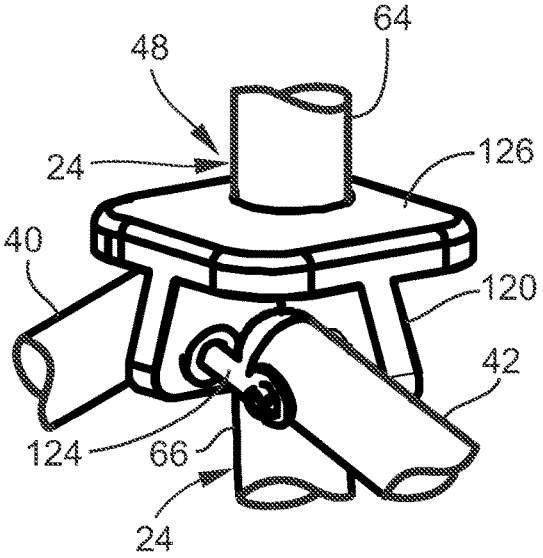
FIG. 15D is a perspective view of the upper collar apparatus on the right rear leg of the high chair apparatus of FIG. 1.

As shown in FIG. 12, back 76 is disposed forwardly of a rear edge of seat 106. Grommets 128 have a forward most portion and the lower edge of back 76 runs adjacent to such forward most portion of the grommets 128 that engage rear legs 22, 24.

As shown in FIG. 12, cross-supports 32, 34, 36, 38 include a pin connector 150 for pivotally engaging first and second support members 40, 42 at their intermediate portions. At their intermediate portions, first and second support members 40, 42 are spaced apart by a plastic washer 152. Each of the first and second support members 40, 42 are pivotally engaged at three locations, where one location is intermediate its ends, where one location is at its upper end to upper collar apparatus 48, and where one location is at its lower end to either front or rear lower collar apparatus 54, 56.

In each of the cross-supports 32, 34, 36, 38, support member 40 crosses in front of its paired support member 42. In each of the cross-supports 32, 34, 36, 38, support member 42 crosses to the rear of its paired support member 40.

Grommets 128 are disposed or engaged in each of the four corners of seat 106, engage each of the legs 18, 20, 22, 24, and abut each of the platforms 126 of the upper collar apparatus 48.

In operation, to fold the high chair apparatus 10 from the folded in position as shown in FIG. 10 to the folded out position as shown in FIG. 2, any two of the legs 18, 20, 22, 24 may be held and then spread apart. Such action spreads apart all of the legs 18, 20, 22, 24 through the interaction or scissoring of the cross-supports 32, 34, 36, 38 and such action slidingly draws the lower collar apparatus 54, 56 toward the stops 84. The scissoring or spreading apart ends when the sliding lower collar apparatus 54, 56 make contact with the stops 84, whereupon the spring biased members 82 snap into holes in the rear legs 22, 24, and whereupon the high chair apparatus 10 attains the folded out position shown in FIG. 2. In such folded out position, with spring biased members 82 locked into their respective holes, feet 68 of legs 18, 20, 22, 24 have a wide foot print or wide foot plant that is provided by the continuously outwardly extending legs 18, 20, 22, 24. Specifically, the portions of the legs 18, 20, 22, 24 that provide this wide foot print extend from immediately below the bottom of upper collar apparatus 48 to the feet 68 and to the bottom of the feet 68. In other words, such portions begin with bend 66 and continue down to and through the feet 68. Such portions incrementally and continuously extend further away from each other. Each such portion is made up of the bend 66, the lower elongate portion 60, the lower leg portion 28, and the foot 68. With such a wide foot print, a child can be placed safely in sitting receptacle 14. Then the tray 16 can be engaged to the upper block ends 70, as shown in FIG. 3.

In operation, to fold the high chair apparatus 10 from the folded out position as shown in FIG. 3 to the folded in position as shown in FIG. 10, the tray 16 is first disengaged from the upper block ends 70. Then the spring biased members 82 of the two lower rear collar apparatus 56 may be pulled out so as to disengage their inner pins from holes in the rear legs 22, 24. Then any two of the legs 18, 20, 22, 24 may be held and pushed together. As such two legs 18, 20, 22, 24 are pushed together, the cross-supports 32, 24, 26, 28 through a scissoring action draw all legs 18, 20, 22, 24 toward all of the other legs 18, 20, 22, 24 such that lower collar apparatus 54, 56 slide on the legs 18, 20, 22, 24 and away from stops 84. Such sliding or such drawing in of the legs 18, 20, 22, 24 ends when inner and side portions of the lower collar apparatus 54, 56 make contact with inner and side portion of other lower collar apparatus 54, 56. In the folded in position, all lower collar apparatus 54, 56 are adjacent to all other lower collar apparatus 54, 56. In such folded in position of FIG. 10, the portions of legs 18, 20, 22, 24 below the upper collar apparatus 48 taper away from each other, as can be seen by comparing how adjacent the lower collar apparatus 54, 56 are to each other and how adjacent the feet 68 are to each other. The lower collar apparatus 54, 56 are closely adjacent to each other whereas the lower collar apparatus 54, 56 are less adjacent to each other.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A high chair apparatus, comprising:

a) a sitting receptacle in which a child sits;

b) first, second, third, and fourth legs engaged to the sitting receptacle and supporting the sitting receptacle relative to a floor;

c) each of the first, second, third, and fourth legs having an upper leg portion engaging the sitting receptacle and a lower leg portion having a lower end, each of the lower ends being adjacent to the floor;

d) the first leg being a right front leg and having a right front upper leg portion and a right front lower leg portion, the second leg being a left front leg and having a left front upper leg portion and a left front lower leg portion, the third leg being a left rear leg and having a left rear upper leg portion and a left rear lower leg portion, and the fourth leg being a right rear leg and having a right rear upper leg portion and a right rear lower leg portion;

e) first, second, third, and fourth cross-supports, each of the cross-supports including first and second support members pivotally engaged to each other, each of the first and second support members extending between two adjacent upper leg portions, each of the first and second support members having an upper end pivotally engaged to one of said two adjacent upper leg portions at a location, each of the first and second support members having a lower end pivotally engaged to one of said two adjacent upper leg portions;

f) the first cross-support engaging the first and second legs, the second cross-support engaging the second and third legs, the third cross-support engaging the third and fourth legs, and the fourth cross-support engaging the fourth and first legs;

g) the first, second, third, and fourth legs having a folded in position where the first, second, third, and fourth legs are adjacent to each other;

h) the first, second, third, and fourth legs having a folded out position where the first, second, third, and fourth legs are spaced apart from each other;

i) the first, second, third, and fourth legs being drawable outwardly from the folded in position to the folded out position;

j) the first, second, third, and fourth legs being drawable inwardly from folded out position to the folded in position;

k) each of the first, second, third, and fourth legs in the folded out position being further apart incrementally from each of the other first, second, third, and fourth legs from said location to said lower end of each of the first, second, third, and fourth legs such that each of the first, second, third, and fourth legs begins to extend outwardly at such location and continuously maintains an outward extension to the lower end of each of the first, second, third, and fourth legs such that the first, second, third, and fourth legs provide a wide base for the sitting receptacle; and l) wherein each of the first, second, third, and fourth legs includes an upper collar and a lower collar, the upper collar engaging two upper ends of two adjacent cross supports, the lower collar engaging two lower ends of two adjacent cross supports, the upper collar being fixed at said location on said leg, the lower collar being slideable on said leg such that the cross-supports scissor as the lower collar slides down said leg as the first, second, third, and fourth legs are drawn inwardly from the folded out position to the folded in position.

2. The high chair apparatus of claim 1, wherein each of the first, second, third, and fourth legs is tubular.

3. The high chair apparatus of claim 1, wherein each of said upper leg portions is removably engageable to the lower leg portion.

4. The high chair apparatus of claim 1, wherein each of said upper leg portions includes a first elongate portion that includes a first straight axis and a second elongate portion that includes a second straight axis, the first and second straight axis being oblique to each other.

5. The high chair apparatus of claim 1, wherein distal ends of the first, second, third, and fourth legs define a plane, wherein said lower leg portion is oblique to said plane, wherein a lower elongate portion of said upper leg portion includes a straight axis that is oblique to said plane, and wherein an upper elongate portion of said upper leg portion includes a straight axis that is at a right angle to said plane or is at generally a right angle to said plane.

6. The high chair apparatus of claim 1, wherein each of said first, second, third, and fourth legs tapers downwardly and outwardly from said location where the upper end of each of said first and second support members is pivotally engaged to one of said two adjacent upper leg portions, and wherein each of said first, second, third, and fourth legs extends upright or generally upright from said location.

7. The high chair apparatus of claim 1, wherein the right front leg includes a right front uppermost end, wherein the left front leg includes a left front uppermost end, wherein the right rear leg includes a right rear uppermost end, wherein the left rear leg includes a left rear uppermost end, wherein the right rear and left rear uppermost ends are disposed at a greater distance from said location than are the right front and left front uppermost ends, wherein the right front and left front uppermost ends engage a tray, and wherein the right rear and left rear uppermost ends are adjacent to a back of the sitting receptacle.

8. The high chair apparatus of claim 1, wherein the lower collar of each of the third and fourth legs is lockable to said respective third and fourth legs when the first, second, third, and fourth legs are in the folded out position.

9. The high chair apparatus of claim 1, wherein the lower collar of each of the first and second legs is free to slide when the first, second, third, and fourth legs are in the folded out position, when the first, second, third, and fourth legs are in the folded in position, and when the first, second, third, and fourth legs are in any position between the folded out and folded in positions.

10. The high chair apparatus of claim 1, and further comprising first, second, third, and fourth feet engaged respectively to said first, second, third, and fourth legs at the lower end, the foot having a receptacle for the lower end, the receptacle having an axis and being coaxial with the lower end and lower leg portion, the foot having a bottom, the bottom defining a plane that engages the floor and that is oblique relative to the axis of the receptacle.

11. The high chair apparatus of claim 1, wherein said locations of the first, second, third, and fourth legs define a plane when the first, second, third, and fourth legs are in the folded out position, wherein the lower leg portion is straight, wherein each of the lower leg portions is disposed at an oblique angle relative to said plane, wherein said oblique angles are identical, and further comprising first, second, third, and fourth feet engaged respectively to said first, second, third, and fourth legs at the lower end, the foot having a receptacle for the lower end, the receptacle having an axis and being coaxial with the lower end and lower leg portion, the foot having a bottom, the bottom defining a plane that engages the floor and that is disposed at an oblique angle relative to the axis of the receptacle, and each of the feet being interchangeable with any one of the other feet.

12. The high chair apparatus of claim 1, wherein the sitting receptacle is flexible.

13. The high chair apparatus of claim 1, wherein the sitting receptacle includes a seat, a back, a left side, and a right side, and wherein each of the seat, back, left side, and right side is formed of a flexible material.

14. The high chair apparatus of claim 1, wherein the sitting receptacle includes a seat, a back, a left side, and a right side, wherein the seat is engaged to each of the back, left side, and right side, wherein the back is engaged to each of the seat, left side, and right side, wherein the right side is engaged to each of the seat and the back, and wherein the left side is engaged to each of the seat and the back, and wherein each of the seat, back, left side, and right side is formed of a flexible material.

15. The high chair apparatus of claim 1 and further comprising a tray, wherein each of the first and second legs includes an upper end that comprises a block, and the tray engaging the blocks of the upper ends of the first and second legs.

16. A high chair apparatus, comprising:

a) a sitting receptacle in which a child sits;

b) first, second, third, and fourth legs engaged to the sitting receptacle and supporting the sitting receptacle relative to a floor;

c) each of the first, second, third, and fourth legs having an upper leg portion engaging the sitting receptacle and a lower leg portion having a lower end, each of the lower ends being adjacent to the floor;

d) the first leg being a right front leg and having a right front upper leg portion and a right front lower leg portion, the second leg being a left front leg and having a left front upper leg portion and a left front lower leg portion, the third leg being a left rear leg and having a left rear upper leg portion and a left rear lower leg portion, and the fourth leg being a right rear leg and having a right rear upper leg portion and a right rear lower leg portion;

e) first, second, third, and fourth cross-supports, each of the cross-supports including first and second support members pivotally engaged to each other, each of the first and second support members extending between two adjacent upper leg portions, each of the first and second support members having an upper end pivotally engaged to one of said two adjacent upper leg portions at a location, each of the first and second support members having a lower end pivotally engaged to one of said two adjacent upper leg portions;

f) the first cross-support engaging the first and second legs, the second cross-support engaging the second and third legs, the third cross-support engaging the third and fourth legs, and the fourth cross-support engaging the fourth and first legs;

g) the first, second, third, and fourth legs having a folded in position where the first, second, third, and fourth legs are adjacent to each other;

h) the first, second, third, and fourth legs having a folded out position where the first, second, third, and fourth legs are spaced apart from each other;

i) the first, second, third, and fourth legs being drawable outwardly from the folded in position to the folded out position;

j) the first, second, third, and fourth legs being drawable inwardly from folded out position to the folded in position;

k) each of the first, second, third, and fourth legs in the folded out position being further apart incrementally from each of the other first, second, third, and fourth legs from said location to said lower end of each of the first, second, third, and fourth legs such that each of the first, second, third, and fourth legs begins to extend outwardly at such location and continuously maintains an outward extension to the lower end of each of the first, second, third, and fourth legs such that the first, second, third, and fourth legs provide a wide base for the sitting receptacle; and l) wherein each of the first, second, third, and fourth legs includes an upper collar and a lower collar, the upper collar engaging two upper ends of two adjacent cross supports, the lower collar engaging two lower ends of two adjacent cross supports, the upper collar having an upper axis, the lower collar having a lower axis, the upper and lower axis being oblique relative to each other.

17. A high chair apparatus, comprising:

a) a sitting receptacle in which a child sits;

b) first, second, third, and fourth legs engaged to the sitting receptacle and supporting the sitting receptacle relative to a floor;

c) each of the first, second, third, and fourth legs having an upper leg portion engaging the sitting receptacle and a lower leg portion having a lower end, each of the lower ends being adjacent to the floor;

d) the first leg being a right front leg and having a right front upper leg portion and a right front lower leg portion, the second leg being a left front leg and having a left front upper leg portion and a left front lower leg portion, the third leg being a left rear leg and having a left rear upper leg portion and a left rear lower leg portion, and the fourth leg being a right rear leg and having a right rear upper leg portion and a right rear lower leg portion;

e) first, second, third, and fourth cross-supports, each of the cross-supports including first and second support members pivotally engaged to each other, each of the first and second support members extending between two adjacent upper leg portions, each of the first and second support members having an upper end pivotally engaged to one of said two adjacent upper leg portions at a location, each of the first and second support members having a lower end pivotally engaged to one of said two adjacent upper leg portions;

f) the first cross-support engaging the first and second legs, the second cross-support engaging the second and third legs, the third cross-support engaging the third and fourth legs, and the fourth cross-support engaging the fourth and first legs;

g) the first, second, third, and fourth legs having a folded in position where the first, second, third, and fourth legs are adjacent to each other;

h) the first, second, third, and fourth legs having a folded out position where the first, second, third, and fourth legs are spaced apart from each other;

i) the first, second, third, and fourth legs being drawable outwardly from the folded in position to the folded out position;

j) the first, second, third, and fourth legs being drawable inwardly from folded out position to the folded in position;

k) each of the first, second, third, and fourth legs in the folded out position being further apart incrementally from each of the other first, second, third, and fourth legs from said location to said lower end of each of the first, second, third, and fourth legs such that each of the first, second, third, and fourth legs begins to extend outwardly at such location and continuously maintains an outward extension to the lower end of each of the first, second, third, and fourth legs such that the first, second, third, and fourth legs provide a wide base for the sitting receptacle; and l) wherein each of the first, second, third, and fourth legs includes a lower collar, the lower collar engaging two lower ends of two adjacent cross supports, the lower collar being slideable on said leg such that the cross-supports scissor as the lower collar slides down said leg as the first, second, third, and fourth legs are drawn inwardly from the folded out position to the folded in position, and wherein each of the first, second, third, and fourth legs includes a stop engaged thereto and disposed immediately adjacent to said lower collar when the first, second, third, and fourth legs are in the folded out position, the stop being disposed between the lower collar and the sitting receptacle.

18. A high chair apparatus, comprising:

a) a sitting receptacle in which a child sits;

b) first, second, third, and fourth legs engaged to the sitting receptacle and supporting the sitting receptacle relative to a floor;

c) each of the first, second, third, and fourth legs having an upper leg portion engaging the sitting receptacle and a lower leg portion having a lower end, each of the lower ends being adjacent to the floor;

d) the first leg being a right front leg and having a right front upper leg portion and a right front lower leg portion, the second leg being a left front leg and having a left front upper leg portion and a left front lower leg portion, the third leg being a left rear leg and having a left rear upper leg portion and a left rear lower leg portion, and the fourth leg being a right rear leg and having a right rear upper leg portion and a right rear lower leg portion;

e) first, second, third, and fourth cross-supports, each of the cross-supports including first and second support members pivotally engaged to each other, each of the first and second support members extending between two adjacent upper leg portions, each of the first and second support members having an upper end pivotally engaged to one of said two adjacent upper leg portions at a location, each of the first and second support members having a lower end pivotally engaged to one of said two adjacent upper leg portions;

f) the first cross-support engaging the first and second legs, the second cross-support engaging the second and third legs, the third cross-support engaging the third and fourth legs, and the fourth cross-support engaging the fourth and first legs;

g) the first, second, third, and fourth legs having a folded in position where the first, second, third, and fourth legs are adjacent to each other;

h) the first, second, third, and fourth legs having a folded out position where the first, second, third, and fourth legs are spaced apart from each other;

i) the first, second, third, and fourth legs being drawable outwardly from the folded in position to the folded out position;

j) the first, second, third, and fourth legs being drawable inwardly from folded out position to the folded in position;

k) each of the first, second, third, and fourth legs in the folded out position being further apart incrementally from each of the other first, second, third, and fourth legs from said location to said lower end of each of the first, second, third, and fourth legs such that each of the first, second, third, and fourth legs begins to extend outwardly at such location and continuously maintains an outward extension to the lower end of each of the first, second, third, and fourth legs such that the first, second, third, and fourth legs provide a wide base for the sitting receptacle; and l) further comprising a frame, the frame including the first, second, third, and fourth legs, the frame further including a tray engaged to the first and second legs, the tray including a rigid material that spaces apart the first and second legs when the first, second, third, and fourth legs are in the folded out position, the tray being removable from the first and second legs, the tray when engaged to the first and second legs preventing the first, second, third, and fourth legs from being folded from the folded out position to the folded in position, the first, second, third, and fourth legs being foldable from the folded out position to the folded in position when the tray is disengaged from the first and second legs.

* * * * *